US011466441B2

(12) United States Patent
Ravenscroft

(10) Patent No.: US 11,466,441 B2
(45) Date of Patent: Oct. 11, 2022

(54) DEPLOYABLE MOUNTING SYSTEM FOR PLUMBED EQUIPMENT

(71) Applicant: PELHAM PUBLICATIONS LIMITED, London (GB)

(72) Inventor: Pelham Montague Raphe Ravenscroft, Alton (GB)

(73) Assignee: MAXYMYS LIMITED, Kent (GB)

( * ) Notice: Subject to any disclaimer, the term of this patent is extended or adjusted under 35 U.S.C. 154(b) by 635 days.

(21) Appl. No.: 16/336,487

(22) PCT Filed: Sep. 26, 2017

(86) PCT No.: PCT/GB2017/052868
§ 371 (c)(1),
(2) Date: Mar. 26, 2019

(87) PCT Pub. No.: WO2018/055415
PCT Pub. Date: Mar. 29, 2018

(65) Prior Publication Data

US 2021/0285200 A1 Sep. 16, 2021

(30) Foreign Application Priority Data

Sep. 26, 2016 (GB) ..... 1616329

(51) Int. Cl.
*E03D 11/12* (2006.01)
*E03D 11/16* (2006.01)
*E03D 11/17* (2006.01)

(52) U.S. Cl.
CPC ..... *E03D 11/12* (2013.01); *E03D 11/16* (2013.01); *E03D 11/17* (2013.01)

(58) Field of Classification Search
CPC ..... E03D 11/12; E03D 11/16; E03D 11/17; E03D 11/143; E03D 11/146; E03D 11/14; A47K 4/00; E03C 2201/90
See application file for complete search history.

(56) References Cited

U.S. PATENT DOCUMENTS 1,305,624 A * 6/1919 Schneider ..... 4/644
2,076,950 A 4/1937 Koch
(Continued)

FOREIGN PATENT DOCUMENTS

CA 1108804 A 9/1981
CN 2375686 Y 4/2000
(Continued)

OTHER PUBLICATIONS

Lagares, "Fontdarquitectura", RCR Arquitectes, Jan. 1, 2015, 1 page.
(Continued)

*Primary Examiner* — Erin Deery
(74) *Attorney, Agent, or Firm* — Rankin, Hill & Clark LLP

(57) ABSTRACT

There is disclosed a mounting assembly for moveably mounting an item of plumbed equipment to a fixed surface. The assembly comprises a fixed mounting portion and a moveable mounting bracket for receiving the item of plumbed equipment. Moveable fluid connections are provided for moveably connecting the item to a fixed fluid source and/or to a fixed waste port. Space saving bathroom installations are disclosed, and the item can be moveably mounted using linear or rotational movement between its stowed and deployed positions.

20 Claims, 23 Drawing Sheets

(56) References Cited

U.S. PATENT DOCUMENTS

| | | | | |
|---|---|---|---|---|
| 2,202,486 | A | 5/1940 | Fredrickson et al. | |
| 2,443,214 | A | 6/1948 | Williams | |
| 3,129,437 | A * | 4/1964 | Mcclenahan | E03D 11/143 4/252.2 |
| 3,467,966 | A | 9/1969 | Gregori et al. | |
| 3,829,906 | A * | 8/1974 | McPhee | E03D 9/002 4/312 |
| 4,045,827 | A * | 9/1977 | Morris | E03D 11/12 4/664 |
| 4,089,073 | A | 5/1978 | Campbell | |
| 5,257,422 | A * | 11/1993 | Ruegg | E03D 11/14 4/252.2 |
| 5,765,237 | A | 6/1998 | Okamoto et al. | |
| 6,986,171 | B1 | 1/2006 | Perrin | |
| 9,021,620 | B1 * | 5/2015 | Walker | E03C 1/322 4/252.2 |
| 2010/0229293 | A1 | 9/2010 | Rodgers et al. | |
| 2012/0079650 | A1 | 4/2012 | Metcalf et al. | |

FOREIGN PATENT DOCUMENTS

| | | | |
|---|---|---|---|
| CN | 201445433 | U | 5/2010 |
| CN | 201695497 | U | 1/2011 |
| CN | 104452936 | A | 3/2015 |
| DE | 2612163 | A1 | 10/1977 |
| DE | 19647072 | A1 | 7/1997 |
| EP | 2813398 | A1 | 12/2014 |
| ES | 2332974 | A1 | 2/2010 |
| FR | 2407700 | A1 | 6/1979 |
| GB | 2436838 | A | 10/2007 |
| KR | 101299122 | B | 8/2013 |
| WO | 2011/098620 | A1 | 8/2011 |

OTHER PUBLICATIONS

WC Lagares In, "Installation Manual—Technical Characteristics Use and Maintenance", Designed by RCR Arquitectes, www.lagares.com, Jan. 1, 2015, 13 pages.

Third Party Video from private art gallery in London, "Fold up-in loo", Jan. 1, 2015, 9 pages.

International Search Report and Written Opinion, International Application No. PCT/GB2017/052868 dated Mar. 8, 2018, 10 pages.

Great Britain Search Report, Application No. GB 1616329.7, dated Nov. 21, 2016, 4 pages.

Whitehall Free-Standing Bedside Patient Care Unit (formerly referred to as Swivette), Includes Models 4010, 4012, 4015, Last Update Aug. 4, 2018, Whitehall Mfg., City of Industry, California, 3 pages.

Webpage : "Free-Standing Cabinet, Pivoting Toilet, Rectangular Lavatory, Back Waste Outlet", Model No. 4010, Whitehall Manufacturing, Webpage: https://www.whitehallmfg.com/patient-care-units-back-waste-outlet, 1 page.

* cited by examiner

DEPLOYABLE MOUNTING SYSTEM FOR PLUMBED EQUIPMENT

FIELD OF THE INVENTION

The present invention relates to plumbed equipment such as toilet pan, sinks, bidets baths and the like. In particular, the invention relates to novel mounting arrangements for mounting plumbed equipment, i.e. equipment having water supply and/or waste water drainage connected thereto.

BACKGROUND TO THE INVENTION

In a majority of cases, plumbed bathroom equipment is fixedly mounted to a wall or to a floor. Fixed water supply pipes will provide a water supply to the equipment, usually delivered by some switchable valve means, such as conventional taps, or in the case of a toilet cistern, via a ballcock or similar semi-automated valve arrangement. Water will be delivered to the equipment and either held within it, e.g. water held in a sink, bidet or bath, and then removed via a waste pipe. Alternatively, in the case of a toilet pan, an amount of water is retained in the u-bend at all times and large volumes are flushed through the pan to remove waste after use. U-bends are also generally present in sink, bidet or bath drain connections. Such plumbed items are conventionally mounted in fixed positions on a wall or floor of the room, cubicle or other enclosure in which they are installed. However, such fixed installations have their drawbacks. Space required for use of a toilet, bath or bidet is often only used by a user for a very small percentage of the time, however space must be provided at all times for fixed appliances and so this can result in an inefficient use of space in a commercial or domestic building. In metropolitan areas in particular, space is increasingly at a premium. There is therefore a need for improved mounting systems which make more efficient use of the space required to use plumbed items of equipment.

SUMMARY OF THE INVENTION

There is disclosed a mounting assembly for moveably mounting an item of plumbed equipment to a fixed surface. The assembly comprises a fixed mounting portion and a moveable mounting bracket for receiving the item of plumbed equipment. Moveable fluid connections are provided for moveably connecting the item to a fixed fluid source and/or to a fixed waste port. Space saving bathroom installations are disclosed, and the item can be moveably mounted using linear or rotational movement between its stowed and deployed positions.

The invention provides a mounting assembly for movably mounting an item of plumbed equipment to a fixed surface, having:

- a support assembly comprising a fixed support and a moveable bracket configured to receive the item, the support assembly configured to movably mount the moveable bracket to a fixed surface via the fixed support, so as to move the item between a first, stowed, position, and a second, deployed, position;
- a water supply connection, configured to connect a water supply from a fixed supply point to the moveably mounted item; and
- a waste water connection, configured to moveably connect a waste outlet of the item to a fixed waste port.

The support assembly may be configured to wholly support the weight of the item through the moveable bracket.

This may be done without contact with the ground beneath the item. This may be achieved by providing a cantilevered support to the moveable bracket passing above the pan flush water supply pipe connected to the water supply connection, and above a waste water pipe connected to the waste water connection.

The bracket may comprise a waste opening and a water supply opening to allow passage of the waste water and the water supply through the bracket.

The bracket may be configured with a substantially flat front face configured to accept any proprietary or standard wall-hung toilet pan.

The mounting assembly may be configured to support a load supported at the centre of a toilet pan bowl mounted to the mounting bracket of up to 270 kgs, or more. However being configured to support a load of 200 kg or 250 kg may also be beneficial in certain cases. Such weights can be carried by standard wall hung pans and in general it is preferable for the bracket to be stronger than the ceramic pan mounted to it, such that the pan would fail before he mounting assembly does. Such a configuration is possible in the arrangements shown and described herein.

The moveable bracket may be movably mounted to, and supported by, the fixed support.

The water supply connection may comprise:

- a fixed water supply connector for connection to a water supply in fixed relation to the fixed support;
- a movable water supply connector for connection to a water inlet of the item, the moveable supply connector being mounted in fixed relation to the moveable bracket; and
- a movable fluid connection having a fixed end connected to the fixed water supply connector and a mobile end connected to the movable water supply connector.

The waste water connection may comprise:

- a fixed waste connector for connection to a fixed waste port in fixed relation to the fixed support;
- a movable waste connector for connection to a waste outlet of the item, the moveable waste connector being mounted in fixed relation to the moveable bracket; and
- a moveable waste connection having a fixed end connected to the fixed waste connector and a mobile end connected to the movable waste connector.

The fixed support may comprise a plurality of fixing points for fixing the fixed support to one or more surfaces, the fixing points being vertically or horizontally spaced from one another when installed, so as to fully support the weight of the item in its stowed and deployed positions, when installed.

A moment in a vertical plane induced by the weight of the item may induces tension in an upper fixing point, with the fixed support optionally further comprising a lower portion configured to deliver a compressive force to react the moment created by the item about the upper fixing point.

Movement of the item provided by the support assembly between its stowed and deployed positions may comprise translation and/or rotation in a substantially horizontal plane.

The waste water connection may comprise a flexible waste pipe, configured to allow longitudinal flexure of the waste water connection.

The mounting bracket may comprise a compressible spacer arranged to sit between the bracket and the item of plumbed equipment.

The bracket may comprise a water supply opening to allow passage of the water supply through the bracket.

The bracket may comprise a waste opening to allow passage of the waste water through the bracket.

The mounting assembly may further comprise a water supply extender configured to extend the water supply through the bracket.

The mounting assembly may further comprise a waste water extender configured to extend the waste water outlet of the item through the bracket.

The water supply connection and/or the waste connection may comprise at least one flexible pipe member and a pipe support attached to the support assembly and configured to moveably support the weight of the flexible pipe member between ends of the flexible pipe member.

The mounting assembly may further comprise a door for enclosing the item when in its stowed position, the door being fixedly mounted to the bracket.

The door may comprise first and second door portions being hingedly connected to one another.

The mounting assembly may comprise a door actuator configured to automatically actuate at least one of the door portions to enable the door to open when the item is moved from the stowed position to the deployed position.

The mounting assembly may further comprise a bracket actuator, for actuating the bracket to move it between its stowed and deployed positions.

The mounting assembly may further comprise at least one latch for retaining the item in its stowed position.

The mounting assembly may further comprise at least one latch for retaining the item in its deployed position.

The mounting assembly may further comprise moveable height adjustment means, for adjusting the height of the bracket relative to the fixed surface to a user's needs.

The height adjustment means may be configured to change the height of the both bracket and of a movable connection between a fixed mounting portion of the support assembly and the bracket.

The height adjustment means may comprise a substantially vertical slide disposed between the bracket and a fixed mounting portion of the support assembly.

The mounting assembly may further comprise powered or manually operated actuating means for adjusting the height of the bracket relative to the fixed mounting portion of the support assembly.

The support assembly may comprise one or more hinges for moving the item between its first and second positions a rotational motion, the one or more hinges preferably being mounted so as to be above the water supply connection and above the waste water connection when installed.

The hinge may comprise a plurality of bearings, the bearings being separated vertically from one another so as to support the full weight of the item being supported on the bracket via the bearings without any mobile contact with the floor beneath the item.

The support assembly may comprise a back plate for mounting the support assembly to a wall, a first spacer member arranged to hold the hinge arrangement in spaced relation to the wall on the fixed support, and a bracket connection arranged to hold the bracket in spaced relation to the hinge.

The hinge arrangement may be configured substantially coaxially with the fixed waste port, such that a vertical axis of rotation of the hinge arrangement is substantially coaxial with the fixed waste port.

The support assembly comprises one or more substantially horizontal substantially linear sliding elements, configured to translate the item between its stowed and deployed positions by substantially linear movement.

The water supply connection and/or the waste water connection may comprise a pipe arrangement configured to be substantially length adjustable, optionally telescopic, along its longitudinal axis to adapt its length as the item moves between its deployed and stowed positions.

The length adjustable pipe arrangement may be supported between its ends by one or more linearly displaceable support configured to move substantially linearly as the item moves between its stowed and deployed positions.

The length adjustable pipe arrangement may comprise a bellows arrangement. The length adjustable pipe arrangement may comprises telescopic pipe sections configured to slide axially one inside the other.

The invention further provides a kitchen, bathroom, water closet or other plumbing arrangement comprising an item of plumbing equipment mounted so as to be moveable between stowed and deployed positions via a mounting assembly of the kind described herein.

The invention further provides a method of making a kitchen, bathroom or other plumbing installation, comprising installing a mounting assembly according to the invention, mounting an item of plumbing equipment to the bracket and connecting the water supply and/or waste water connection to the item.

BRIEF DESCRIPTION OF THE DRAWINGS

Embodiments of the invention will now be described with reference to the accompanying drawings, in which.

DETAILED DESCRIPTION OF EMBODIMENT(S)

Figure 1A:
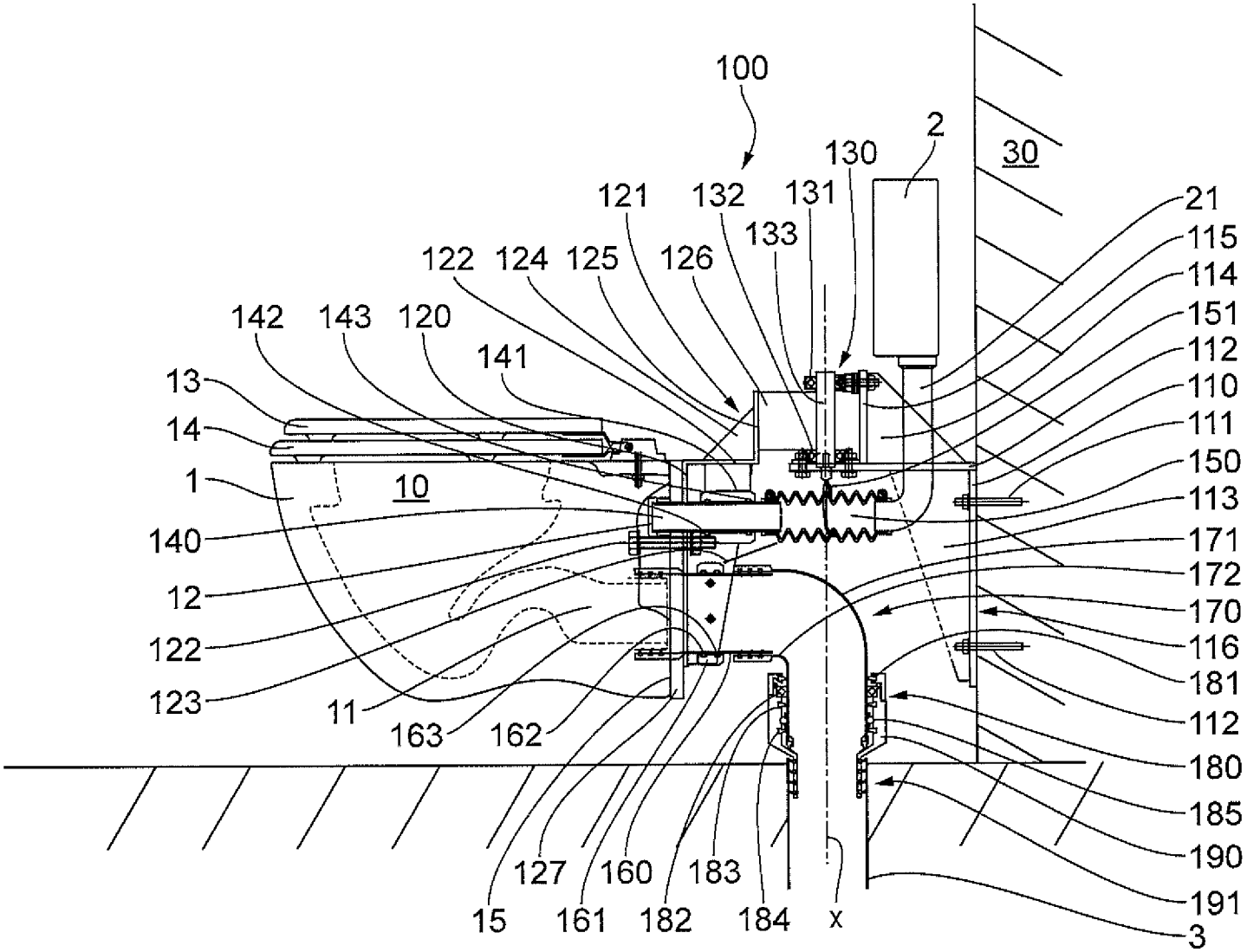
FIGS. 1A to 1E illustrate a mounting assembly, applied to the mounting of a toilet pan, in accordance with the invention.

The following description illustrates a number of methods by which an item of plumbed equipment can be moveably mounted to a fixed surface via a mounting assembly in accordance with embodiments of the invention. When referring to items of plumbed equipment, this generally indicates equipment which involves plumbing connections. The main embodiment refers to connections for a water supply and water waste. However, it is not essential that either or both of those connections is provided for items mounted via mounting assemblies falling within embodiments of the invention. The principal function of the mounting assemblies described herein is to provide a moveable bracket which is configured to receive items of standard plumbing equipment. A further important function is to maintain the item in a suspended state above the floor of the room or other space in which the item is mounted. As such, a moveable bracket is generally configured to receive wall-mounted equipment, such as wall-mounted lavatory pans, wall-mounted bidets, wall-mounted sinks, and other such items of plumbed equipment, i.e. those requiring water or other fluids to be supplied to, and/or waste water taken away from them. As will be demonstrated in the following, numerous different mounting assemblies, according to different embodiments of the invention, can be envisaged which enable the plumbed item to be moved from a first position to a second position via a suspended bracket. The first position is generally described as a stowed position, in which the item is generally retracted away from a space which it occupies for normal use of the item. The stowed position may be configured so as to substantially conceal the item within an enclosure such as a wall cavity, within a cupboard arrangement, or within any other such concealed space. However, the stowed position also encompasses the moveable item simply being stowed away from its location of normal use. For example, the item may be stowed in close proximity to a wall of a space in which it is used, and then may be deployed to a deployed position which is at a greater distance from the wall to enable the user sufficient access around sides of, or above, the item, in order to use it. As will be seen in relation to the following detailed description of the Figures, the mounting assembly can include various moveable connections between a fixed chassis and a dynamic or mobile chassis. Such moveable connections can include rotational hinges for rotating the item into and out of its stowed and deployed positions, as well as means which enable the bracket to be moved between the stowed and deployed positions by substantially linear translation, such as linear runners or slides. As will also be described, the fluid connections into and/or out of the item can be provided by rotational pipe connections, including rotational seals and optional rotational bearings or slip seals such as teflon slip seals. Alternatively, flexible hose sections may be provided to enable the dynamic connection of the water supply and waste connections as the item moves between stowed and deployed positions. For the linear translation/based arrangement, a range of connections can be provided, including bellows-type extendable pipe arrangements, but also including telescopic arrangements. All of these aspects, and more, will become more clearly apparent when considering the following detailed description of the embodiments in the drawings.

FIGS. 1A to 1E illustrate a first arrangement of a mounting assembly according to embodiments of the invention, in which a rotational movement of the item between its stowed and deployed positions is provided.

The item of plumbed equipment in the illustrated examples is a lavatory pan 1 of standard form, which is of the type configured to be mounted to a substantially vertical wall, i.e. of the wall-hung variety. The lavatory pan 1 has a standard cavity 10 from which waste water can pass through a waste outlet 11. When the lavatory is flushed, the flushing water supply enters through a water inlet 12 of standard form. The lavatory pan is provided with a standard hinged lid 13 and seat 14. The pan 1 is generally mounted to a wall, in standard installations, via its rear mounting face 15.

The mounting assembly 100 provided by the present invention enables such a wall-hung item to be moveably mounted to a structure, such as a wall 30, or a floor 31 as shown. The mounting assembly 100 comprises a mounting plate 110 for mounting the mounting assembly to the structure. It further comprises a bracket 120 to which the item (such as lavatory pan 1) can be mounted. A moveable connection, in this case a hinge arrangement 130, is provided between the mounting plate 110 and the bracket 120. The mounting plate 110 is connected to a generally fixed part, or static chassis 116, of the mounting assembly, which may comprise a horizontally extending part 112, which is braced to the mounting plate 110 via a first brace 113. A second brace 114 may be provided between the horizontally extending portion 112 and a hinge support portion 115. The hinge support portion extends in a substantially vertical direction, to enable the hinge arrangement 130 to have adequate vertical height. This enables the hinge arrangement 130 to resist a moment in a vertical plane which will be created by the weight of the lavatory pan 1, and by any user seated upon it. As will be appreciated, the further the pan 1 is mounted from the wall 30 and hinge arrangement 130, the greater will be the forces in the hinge arrangement 10 created by these moments. The hinge arrangement 130 must therefore be suitably sized and dimensioned to carry the weight of the pan 1, and any user seated upon it. One particular suitable form of hinge arrangement is illustrated in FIG. 1A. In this arrangement, the fixed side of the mounting assembly comprises a standard pillow block top bearing, which may be a 25 mm bearing, 131. A bottom bearing 132 is further provided, which may be a 25 mm flange bearing. A shaft 133 is rotatably mounted in the bearings 131 and 132. It is preferred to have two bearings 131 and 132 spaced apart, in order to react the moments acting through the mounting assembly as described above.

The pan 1 is mounted to the moving part of the mounting assembly, i.e. the dynamic pan chassis 121 via the bracket 120. The dynamic chassis 121 can similarly comprise a first brace 125, and a further brace portion 123 may extend between a horizontally extending portion 122 and the bracket 120. A horizontal extension 126 may extend, in a substantially vertical plane, from the shaft 133 to connect the dynamic pan chassis 121 to the shaft 133. A compressible spacer 127 may be provided between the item and the bracket 120, and may substantially cover the full contact area between the item and the bracket.

In the example shown in FIG. 1A, the waste port 3 is a standard 110 mm soil pipe outlet as is used in general domestic installations of lavatories. In this example, the waste port 3 is vertically oriented in the floor 31, and is substantially coaxial with an axis of rotation X of the hinge 133. A waste water connection 170 is provided to connect the waste outlet 11 of the pan 1 to the fixed waste port 3. In this example, the waste water connection 170 includes a bearing arrangement 180, which is arranged to permit axial rotation of the L-bend 171 with respect to the fixed waste port 3. The bearing arrangement 180 comprises at least one rotational seal 181, which permits the L-bend 171 to rotate, whilst maintaining a substantially watertight seal against a surface of the L-bend 171. The seal 181 may be a slip seal such as a teflon slip seal or similar, which may act as both a seal and a load carrying bearing, A load-carrying bearing, such as a ball bearing 182 may also be incorporated. The bearing 182 can assist with ensuring that the L-bend 171 is securely positioned in the appropriate orientation. As is illustrated, the bearing arrangement 180 can be provided in a fixed outlet adaptor 190. However, it would be possible to integrate the bearing and sealing arrangement directly between the waste outlet port 3 and the L-bend 171. A plurality of lip seals 183 and 184 may be provided, and a further roller bearing, or other load bearing element 185 may further be provided to assist with load transfer and steadying of the L-bend 171 relative to the fixed waste port 3, whilst permitting its rotation about its axis X. As illustrated, where the bearing and sealing elements for sealing against the L-bend 171 are incorporated in a fixed waste port adaptor 190, one or more further lip seals 191 may be provided between the adaptor 190 and the fixed waste port 3.

The dynamic chassis 121 may further comprise a water supply extender 140 and/or a waste water extender 160. These are generally provided as elongate pipe members, configured to extend the standard inlet and/or outlet of the item 1 through the bracket 120. This allows the connection of the inlet 11 and outlet 12 to be connected to further parts of the water supply connection 150 and/or waste water connection 170, respectively. Further, the water supply extender 140 can be held in a water supply extender mount 141, which mount may clamp the extender. Such clamping may be provided by resilient means, such as O-rings 142 and 143, but any suitable clamping means for holding the extender 140 in substantially fixed relation to the bracket 120 would be suitable. Similarly, the waste water extender 160 may be retained in a similar manner within a waste water support 161, which is further connected to the dynamic chassis 121. Again, the extender 160 may be clamped within the support 161 and may be retained in place by resilient means, such as O-rings 162 and 163. The extender can terminate in a standard soil pipe outlet, for example a 110 mm soil pipe outlet, and a first end 172 of the L-bend 171 may comprise a standard lip-seal connection for connecting to the extender 160 to receive waste water therefrom.

The water supply connection may comprise a flexible bellows portion 150, which is configured to moveably or dynamically connect the water supply extender 140 to a water supply pipe 21, i.e. allowing movement of the inlet to the pan relative to the source, supply pipe 21. The water supply pipe 21 can extend from a cistern 2 for the lavatory, so that when flushed, water is supplied from the cistern 2, via the flexible water supply connection 150, through the water supply extender 140, to the lavatory pan 1. The flexible water supply connection can have a flexible portion 150 provided in the form of a flexible "bellows"-type pipe section substantially as illustrated, which can be connected to the extender 140 and/or the supply pipe 21, by standard fluid-tight connections, such as by bonding, screw threads or clamping devices such as jubilee clips, for example.

The flexible pipe section 150 may be supported at least one or more points along its length, by a support means, such as support means 151. In the illustrated example, support means 151 can be a simple loop of material, such as plastic or wire, which is suspended from the fixed chassis 116, or from the dynamic chassis 121 or, in the illustrated case, from the hinge arrangement 130.

Figure 1B:
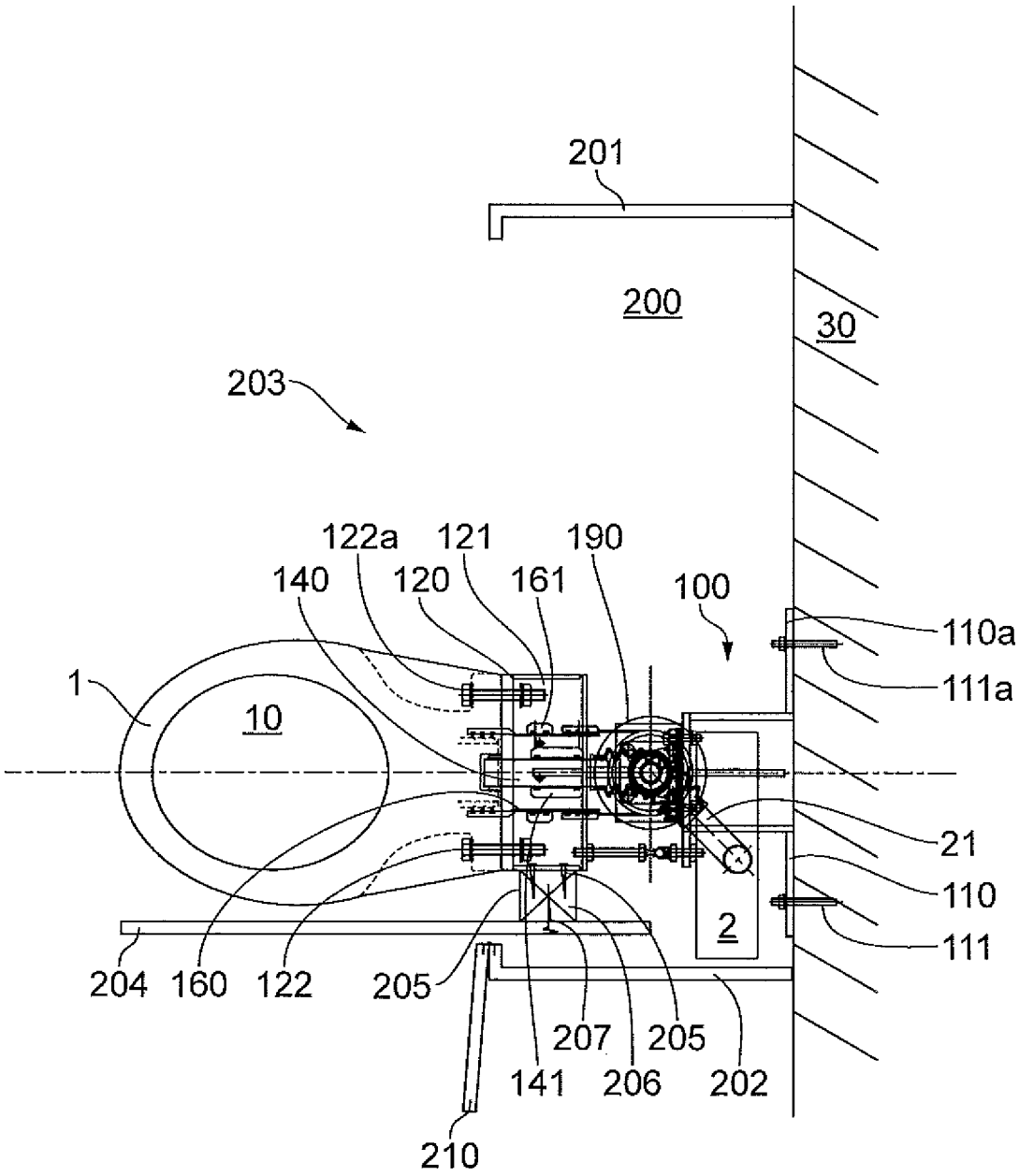

FIG. 1B shows a plan view of the arrangement of FIG. 1A. As can be seen, the fixed support plate 110 may be provided in two parts 110 and 110*a*. However, it will be appreciated that a single plate extending over the full width represented by parts 110 and 110*a* may also be suitable, but it is preferred that the plate allows free passage of the rear exit waste water pipe in versions where the pipe requires this clearance to exit to the rear rather than through the floor. Preferably, the fixing points 111 and 111*a* are provided at a width greater than that of the water supply and waste water connections. This facilitates access to the connection points 111 and 111*a* when installing or maintaining the mounting assembly 100. As is standard for a wall mounted lavatory pan, a plurality of pan fixing connections 122 and 122*a* are provided on substantially opposite sides of the pan. Accordingly, a plurality of corresponding fixing points are provided in the bracket 120 for mounting the lavatory pan 1 thereto. Otherwise, the other features described in relation to FIG. 1A can be seen in the plan view and are correspondingly numbered.

The plan view also allows the illustration of an enclosure 200 into which the lavatory pan 1 can be displaced by means of the mounting arrangement 100. The enclosure 200 has first and second side walls 201 and 202, and an opening 203 through which the lavatory pan 1 can swing into and out of the enclosure 200. For both aesthetic and hygiene reasons, it may be preferred to have a door 204 which substantially encloses the lavatory pan 1 within the enclosure 200 when the lavatory pan 1 is swung into its stowed position in the enclosure 200. The door 204 is preferably directly mounted to the dynamic chassis 121, so that the door 204 can be swung into and out of position with the pan 1. Such an arrangement can be achieved as illustrated by mounting the door 204 to the dynamic chassis 212 by means of fixtures such as screws 205. An optional spacer component 206 may be provided to space the door 204 from the dynamic chassis 121 to accommodate the width of the pan 1 which may be greater than the width of the mounting plate 120 and/or the dynamic chassis 121. Further fixing means 207, which may also be a screw, can be provided to affix the door 204 to the spacer 206. As will be appreciated in relation to later figures, when the door 204 and the pan 1 are swung into a stowed position in the cavity 200, a gap will be present between the door 204 and the second wall 202. Therefore, a swing clearance door 210 can be provided, so as to provide a second closable door, which closes any gap left between the main pan door 204 and the wall 202, so as to provide a fully enclosed enclosure 200, and a substantially flush front face to the enclosure 200 when the lavatory pan 1 is in its stowed position.

Figure 1C:
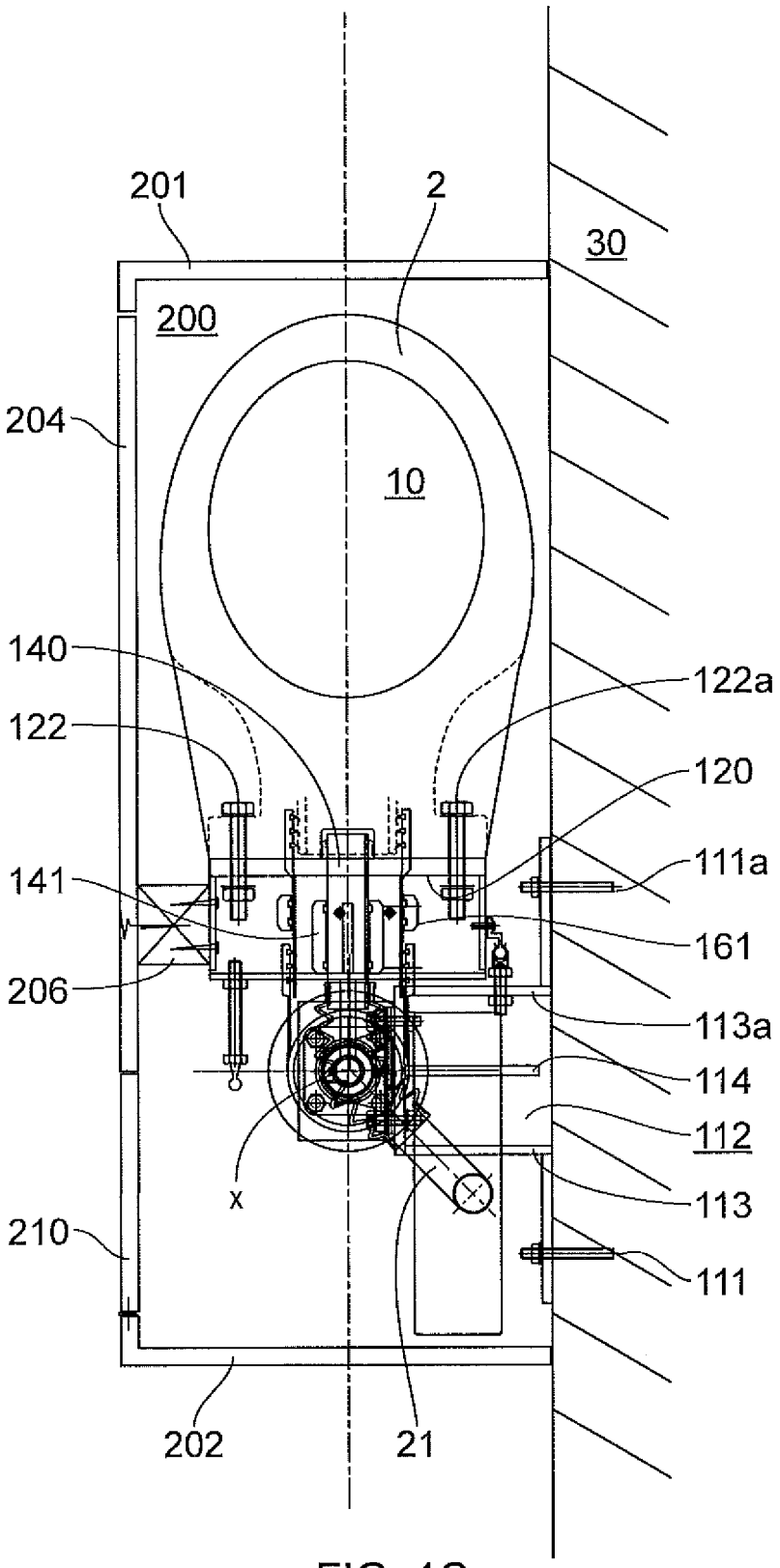

FIG. 1C illustrates the pan 1 in its stowed position in the enclosure 200. As can be seen from the figure, the pan 1 has been rotated about the axis X approximately through a right-angle, i.e. around 90 degrees. This has enabled the pan to be swung from a position where its longitudinal, front-to-back, axis is substantially perpendicular to wall 30, to one in which its longitudinal axis is substantially parallel to wall 30. As will be appreciated from the figures, the mounting plane of the bracket 120 can correspondingly swing from a deployed position in which the plane of the bracket 120 is substantially parallel to the wall 30, to its stowed position in which the plane of the bracket 120 is substantially perpendicular to the wall 30.

In FIG. 1C, brace 113 between the horizontal element 112 and the fixed support plate 110 can be complimented by a second brace 113*a*, and these may be located in spaced relation to one another on either side of the brace 114. Such spacing can assist with resisting the torsional loads which will be placed through the fixed support by the weight of the pan 1 when in the stowed position illustrated in FIG. 1C. The fixing means 111 and 111*a* can be appropriately chosen depending upon the materials of the wall 30 to which the mounting assembly is fixed. However, in the illustrated examples, and where the wall 30 is made from brick or block-work, the fixing means may be M10 resin anchors of standard form, as are well known to those skilled in construction fixings.

Figure 1D:
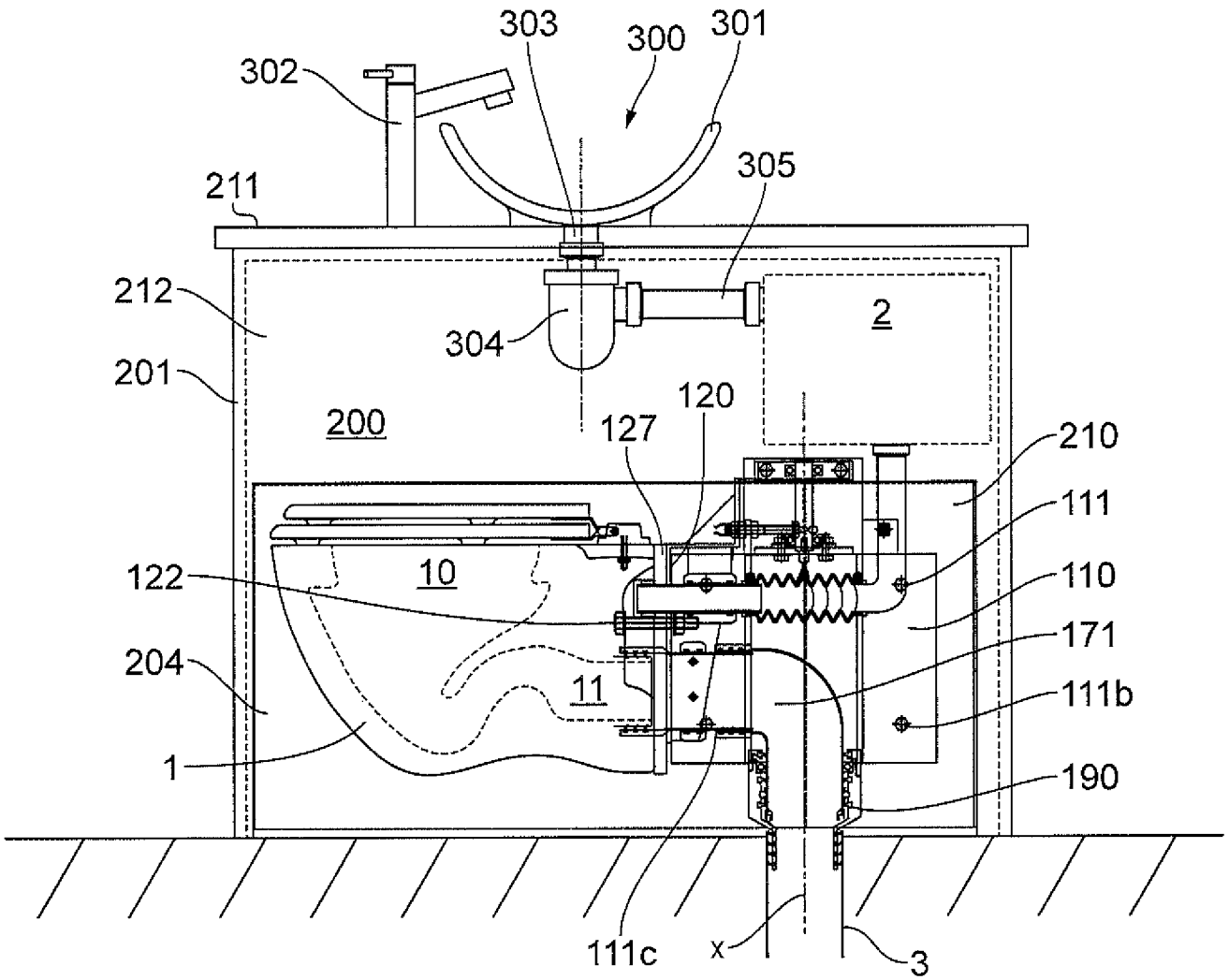

FIG. 1D illustrates the enclosure 200 with the lavatory pan 1 in the stowed position of FIG. 1C. As can be seen from FIGS. 1C and 1D, the enclosure 200 may take the form of a bathroom cabinet. A sink installation 300 may be mounted on an upper surface 211 of the enclosure 200. The sink installation 300 comprises a standard basin unit 301 and a standard tap installation 302. A waste outlet 303 of the basin may pass via a standard U-bend 304. Waste water from the basin 301 is directed via a conduit 305 to the cistern 2, which supplies water to the lavatory pan 1 to flush the lavatory pan in a standard manner. However, the cistern 2 may be substantially increased compared to the capacity of a standard cistern, so as to accommodate waste water from the basin 301, whilst also holding sufficient water, in the absence of any waste water being fed to it from the basin 301 between flushes, to carry out a normal flush of the lavatory pan 1. In addition to the waste water from the basin 301 being fed to the cistern 2, the cistern 2 may also be fed by a standard lavatory cistern feed, with standard ballcock supply system as are well known in the art. Such items being well known to the skilled reader are not described in detail here in the interests of efficiency of the disclosure.

As can be appreciated from FIGS. 1C and 1D, when in the stowed position, the lavatory pan 1 is fully surrounded by the walls 201, 202, upper surface 211, and doors 204 and 210, such that the lavatory pan 1 is concealed within the enclosure 200. The doors 204 and 210, which may be complimented by a further front panel 212 of the enclosure may provide a substantially flush front surface to the enclosure 200, which is visually pleasing, and also is more suitable for efficient cleaning and hygiene purposes.

Figure 1E:
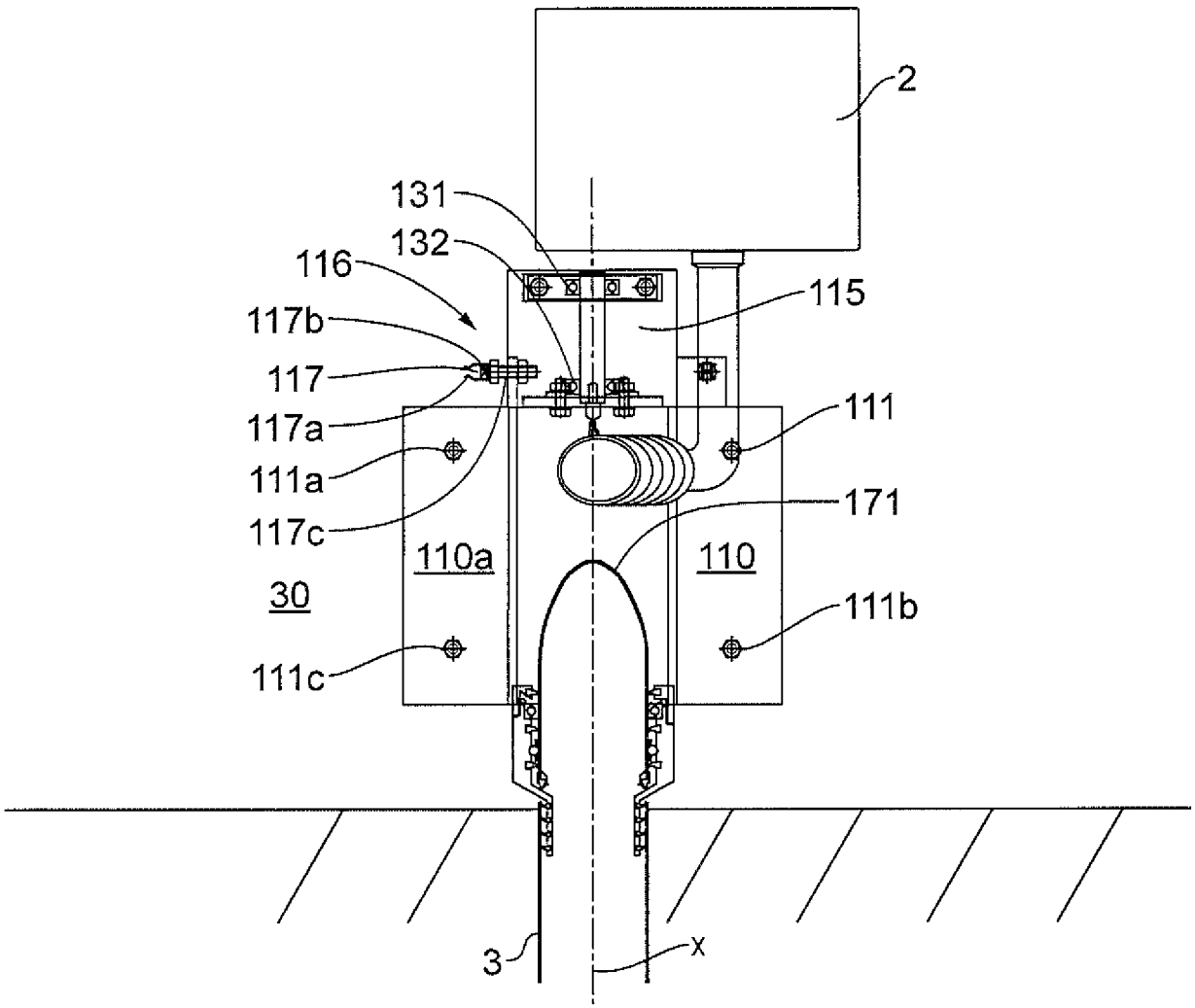

FIG. 1E is a sectional view through the arrangement shown in FIGS. 1A to 1D, from the same angle as shown in FIG. 1D, but omitting the pan 1 and the dynamic chassis 121 of the mounting assembly, for clarity of illustration. The arrangement of fixing points 111 and 111*a*-111*c* can be more clearly seen, these fixing points are spaced from one another in the plane of the wall 30. The static chassis 116 may further comprise a retaining means 117 for retaining the dynamic chassis 121 in the stowed position. In general terms, this may comprise a releasable latch which retains the dynamic chassis 121 to the static chassis 116 when the stowed position. This may come in the form of the spring clip illustrated, but may also come in the form of magnetic latch means, or any other form of repeatedly closable and releasable latching means, such as those used on cupboard doors, for example. Examples include push-to-close, and push-to-release, mechanisms which are well known for re-closable doors, such as kitchen and bathroom cabinets. The retaining means 117 may further include a buffer 117*b*. The buffer acts to gradually absorb some of the kinetic energy of the pan as it swings to the stowed position, to give a gradual slowing of the dynamic chassis and pan 1 when it reaches the stowed position. Suitable means may include, for example, a simple resilient block 117*b* as illustrated in FIG. 1E, which may be made from any resilient material, such as rubber. However, other forms of buffer or damper may be used, for example similar to the soft close mechanisms used in kitchen cabinets and drawers. This damper may be integrated into the shaft 117*c* and/or into the mounting of the shaft 117*c* to the static chassis 116.

Figure 2A:
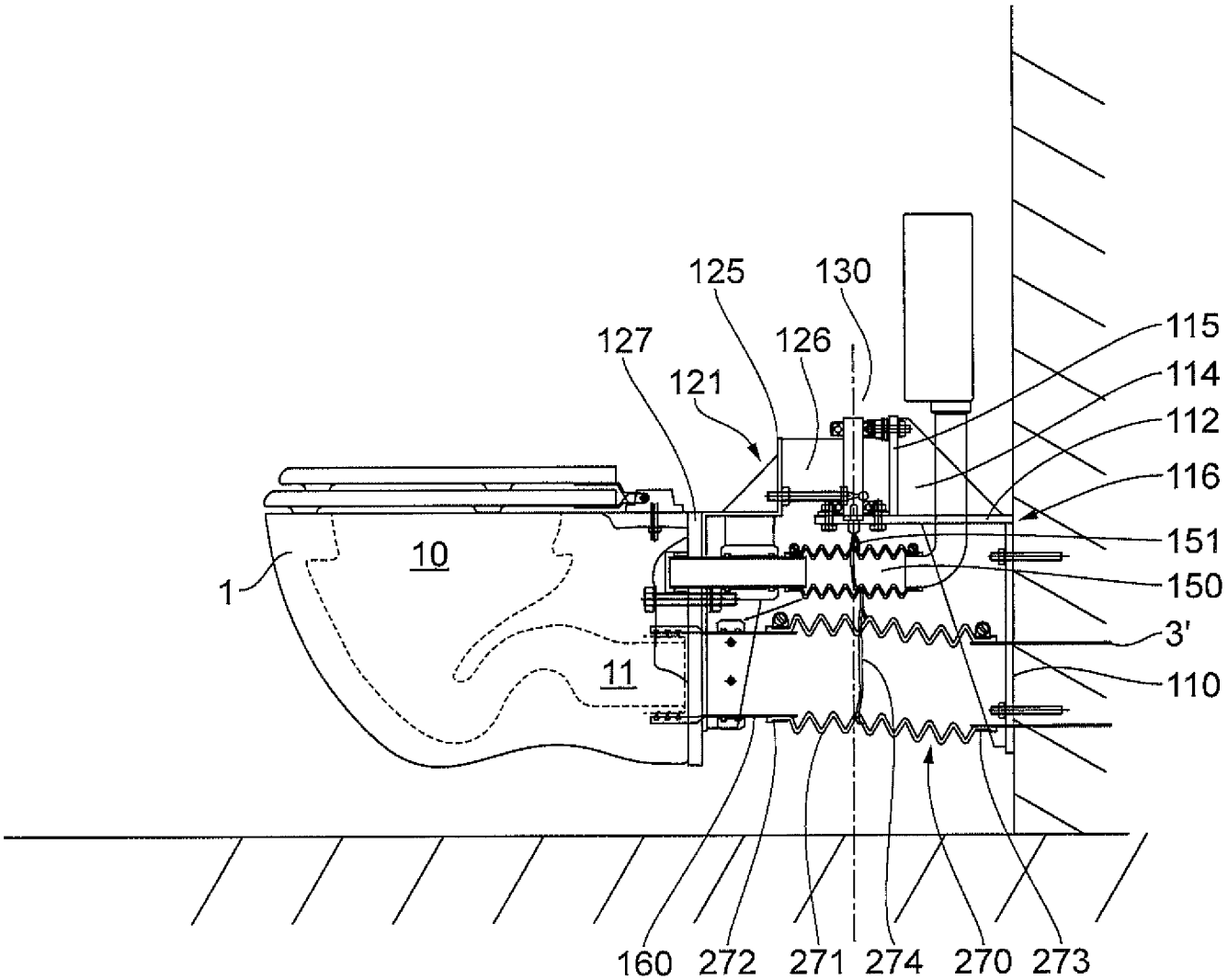
FIGS. 2A to 2D show further variants of a mounting system applied to a mounting of a toilet pan.

FIG. 2A illustrates an alternative arrangement of the waste water connection which can be used with the mounting assembly described so far. With the exception of the waste water connection 270 of FIG. 2A, the remaining features of the arrangement illustrated in FIG. 2A are substantially the same as those illustrated in relation to FIGS. 1A to 1E. The same numerals are therefore applied to those other features for illustrative purposes. The description of FIG. 2A will therefore be limited to the description of the differences in the waste water connection 270. The waste water connection 270 of FIG. 2A serves the same general function as the waste water connection of FIGS. 1A to 1E, namely, to moveably connect a waste outlet 11 of the lavatory pan 1. In the example shown in FIG. 2A, the waste water connection 270 comprises a flexible pipe portion 271. This is connected at its first end to the extender 160 for the waste water connection, and at an opposite end to the waste water port 3'. Between its first 272 and second 273 ends, the flexible pipe section 271 may be supported by a pipe support 274. Similarly to the support 151 for the flexible water inlet connection 150 already described above, the support 274 may be suspended from the static chassis 116, or from the dynamic chassis 121, or from the hinge portion 130. This to prevent sagging of the flexible pipe section between its first 272 and second 273 ends. The flexible connection 270 can take the form of any form of pipe which allows for flexure along its longitudinal axis extending between its first 272 and second 273 ends. The illustrated example is a bellows-type pipe, which may have a similar form to standard flexible connections already used in lavatory pan waste water outlet connections. However, improved materials such as rubber, neoprene and/or silicone may be necessary, to enable it to survive the number of cycles of flexure to which it will be subjected during normal use of the moveable lavatory pan 1.

Figure 2B:
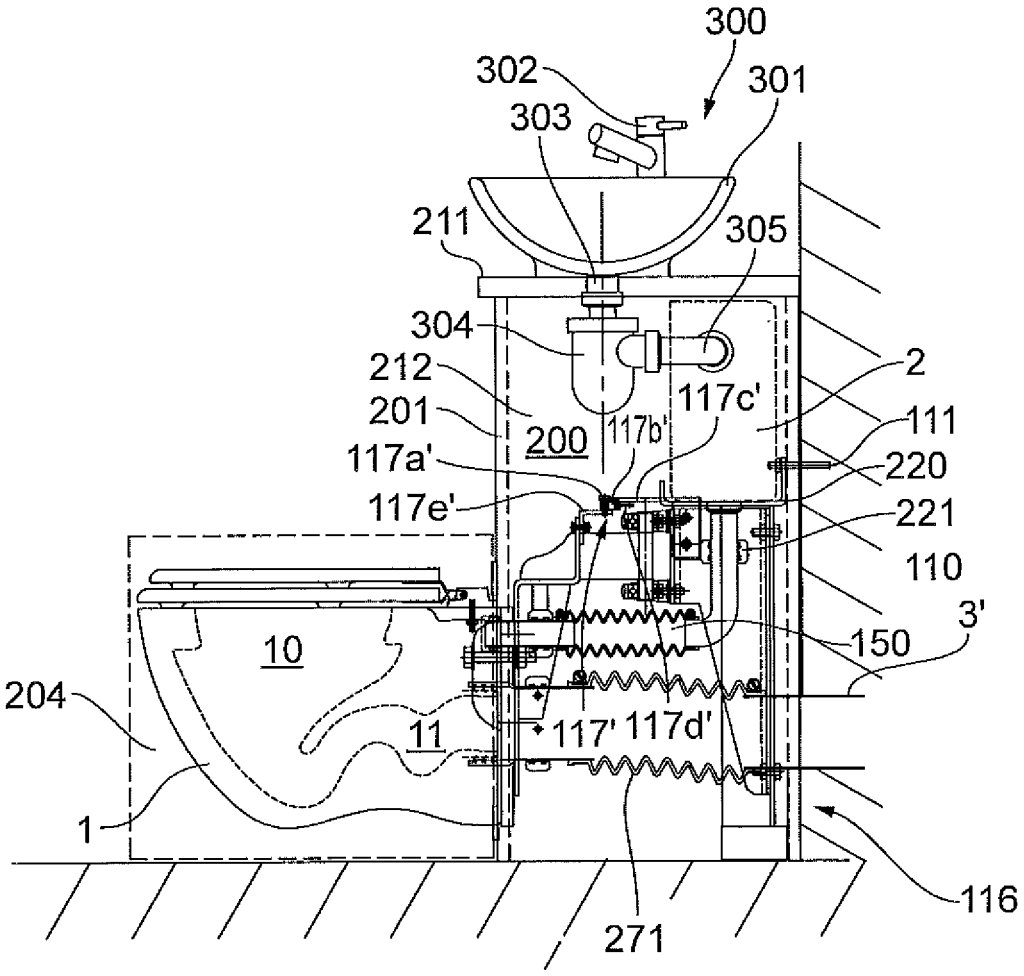

FIG. 2B shows a slightly modified version of the arrangement shown in FIG. 2A, illustrating some further optional features which can be incorporated into the support assembly. In particular, a cistern support 220 in the form of one 'u-channel' top chassis beam incorporating support for the swivel system and the weight of the cistern 2. A cistern pipe support 221 can also be incorporated into the static chassis 116. Further, the fixing points 111 and 111*a* may be located higher than at least the bottom portion of the hinge arrangement of the support assembly. This provides further distance between lower fixing points and upper fixing points of the static chassis to the wall, which provides greater stability to the assembly and can reduce the pulling forces on the upper fixing points due to the longer lever provided by the greater height above the load of the pan and its user.

Figure 2C:
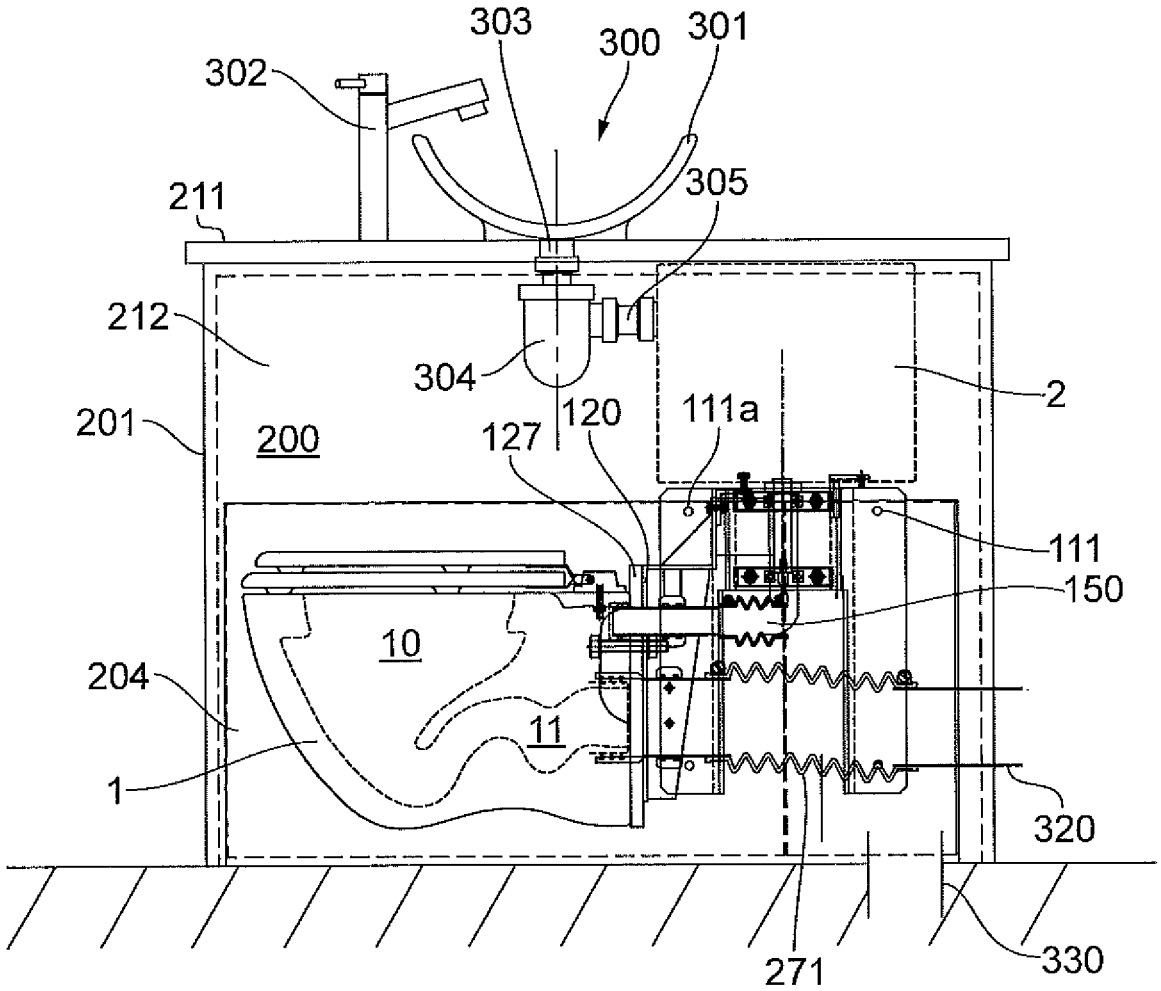

FIG. 2C shows a front view of an alternative arrangement in which the fixed waste port 320 can exit through a side wall of the enclosure 200. Otherwise stated, in the case where there is no enclosure 200 provided, then the port 320 exists to a side of the toilet pan when in its deployed position. In FIG. 2C, the toilet pan is in its stowed position and in this position the flexible pipe 271 connecting the toilet pan to the fixed waste port 320 is in a substantially straight configuration. As will be appreciated, when the pan is deployed into its deployed position, the flexible portion 271 will become bent through substantially 90 degrees whilst maintaining a connection to the fixed waste port 320.

An alternative arrangement for the fixed waste port is shown in which the fixed waste port 330 is located in the ground below the mounting assembly, but not centred on the toilet pan. In this configuration, the flexible portion 271 can again be connected to the fixed waste port 330. The flexible portion 271 will allow deployment of the toilet pan and stowage of the toilet pan whilst maintaining the waste connection to the fixed waste port 330.

Figure 2D:
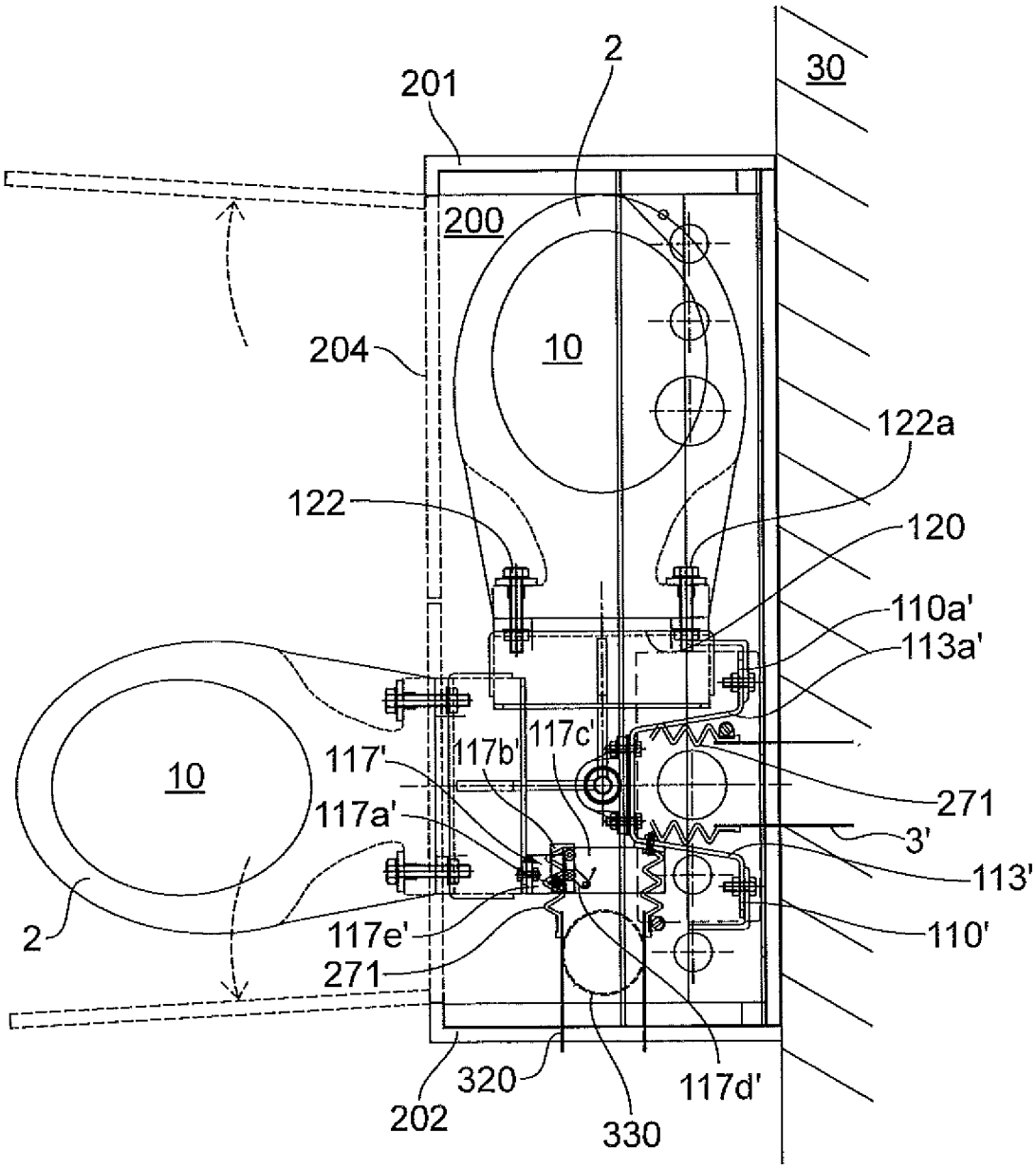

FIG. 2D shows a plan view of various arrangements of the fixed waste port which can be envisaged. As can be seen, the fixed waste port can be provided at a position 330 in the ground as described in relation to FIG. 2C, at position 320 existing to a side of the pan in a substantially horizontal direction, or in the position 3' already described in relation to previous embodiments. By incorporation of the flexible connecting portion 271, the waste port can be accommodated at any of these locations. Variations on the structure of the fixed support can also be seen in FIG. 2D. For example, the two parts 110 and 110*a* of the mounting plate previously described can be integrally formed, as parts 110' and 110*a*', from a single piece of material with the first and/or second brace or braces 113' and 113*a*'. As will be appreciated, any or all of these features can be incorporated with features of the other embodiments described in relation to any of FIGS. 1A to 4C.

FIG. 2D also illustrates an alternative form for the releasable retaining means 117 described in relation to earlier figures. The releasable retaining means 117' takes the form of a slam-lock similar to that used in a car door. The lock body 117*b*' may be mounted substantially horizontally, preferably on a support arm 117*c*' connected or bolted to static chassis 116. A striker 117*a*' is configured so that when in the deployed position, the striker 117*a*' is received in the lock body 117*b*' and latched in place. The lock can be released by a suitable remote connection to the release lever 117*d*'. The release of the lock can be via any remote connection, preferably a cable connection, to a push button situated at a suitable location accessible to the user, for example alongside the loo flush buttons. The lock support bracket 117*e*' mounted on the dynamic chassis 120 carries the corresponding striker which is positioned vertically, so as to engage the lock body when the pan is in the deployed position. This moves in a horizontally oriented arc as part of the general rotation of dynamic chassis 120, and when in the deployed position slots into the securing pawl of the lock body 117*b*' accordingly. The striker can take any suitable form for being received in the lock body, and may be a shaft or a bolt. Release of the lock 117 via the remotely located button then allows stowage of the pan in the stowed position. This form of releasable retaining means can also be used in any of the other embodiments described herein by mounting the striker and lock body suitably positioned on the corresponding respective dynamic and static chassis' of the embodiment in question.

FIGS. 3A to 3G illustrate how actuators may be implemented to enable automated actuation of the support assembly. In the arrangement of FIGS. 3A to 3G, the doors 204 and 210 are connected to one another via a hinge 218, although this is not essential for the automated actuation of the support assembly. Resilient biasing means 217 can be provided to bias the doors 204 and 210 to a parallel position, in which the faces of the doors are substantially aligned with one another, which can provide a substantially flush outer surface. In the illustrated embodiment, this is provided in the form of a first extender arm 215 which extends away from an inner surface of door 204, while a second extender arm 216 extends diagonally from an inner surface of door 210. The resilient biasing means 217 is provided in the form of a spring, which connects distal ends of the two extenders 215 and 216. In the arrangement shown, this biases the two door portions 204 and 210 into substantially parallel, and preferably coplanar, alignment with one another. An opening sequence for the system illustrated in FIGS. 3A to 3F can be controlled by an automated controller 300. The automated controller 300 may have a control connection 301 and 302 for delivering control and/or power signals to first 31 and second 32 actuators of the system. Second actuator 32 is for providing an initial opening action to the second door 210 and may be omitted in certain arrangements, for example if the door 210 is to be released manually before the automated deployment is initiated. Actuator 31 is for actuating the support assembly and so is provided in automated embodiments. Controller 300 may be connected to an input means 303, which may take the form of a button for manual pressing by a user, but could also be automatically actuated, for example by remote detection of a user entering the room in which the lavatory pan 1 is installed, or by detecting their proximity to the installation. Entry detection could be provided by a simple mechanical switch attached to a door to detect when a door is opened. Proximity detection could be in the form of a standard infrared detector, as are used for automated flush devices in public conveniences. A manual button could be a simple push button, or a touch-free infrared detector as used for actuating flush or hand washing devices in public conveniences. The controller 300 can be programmed to carry out any or all of the following steps in response to an actuation input via the input device 303.

In a first step, actuator 32 is extended to extend a distal end 210*a* or door 210 outside of the plane of the door 204 and to avoid interference with wall 202 of the enclosure upon opening. Preferably, once the extension of actuator 32 is complete, actuator 31 may be actuated to commence rotation of the dynamic chassis 121 to its deployed position. Actuator 31 is connected at a first end 311 to a fixed point in fixed relation to the fixed support 116, either directly to the support 116, or to the wall 30. At a second point 312, the actuator 31 is connected to a point on the dynamic chassis. As can be seen, the longitudinal axis of the actuator 31 passes the axis X of the hinge at a point outside of the space between the hinge and the wall 30. Otherwise stated, the hinge axis X in the stowed position lies between the wall 30 and the axis of the actuator 31 in the stowed position. In this way, when actuator 31 is retracted, it will begin to rotate the lavatory pan 1 and dynamic chassis 121 away from the wall 30 and towards the deployed position as illustrated in FIG. 3C. As will be appreciated, an alternative actuator (not shown) could be provided at an opposite side of the axis X of the hinge arrangement 130, and connected to the fixed support or wall at an opposite side of the fixed support 116, so that extension of the actuator pushes the dynamic chassis 121 toward the deployed position. However it can be difficult to provide adequate extension in an actuator located in that position whilst still stowing the whole mechanism within the enclosure 200.

Figure 3B:
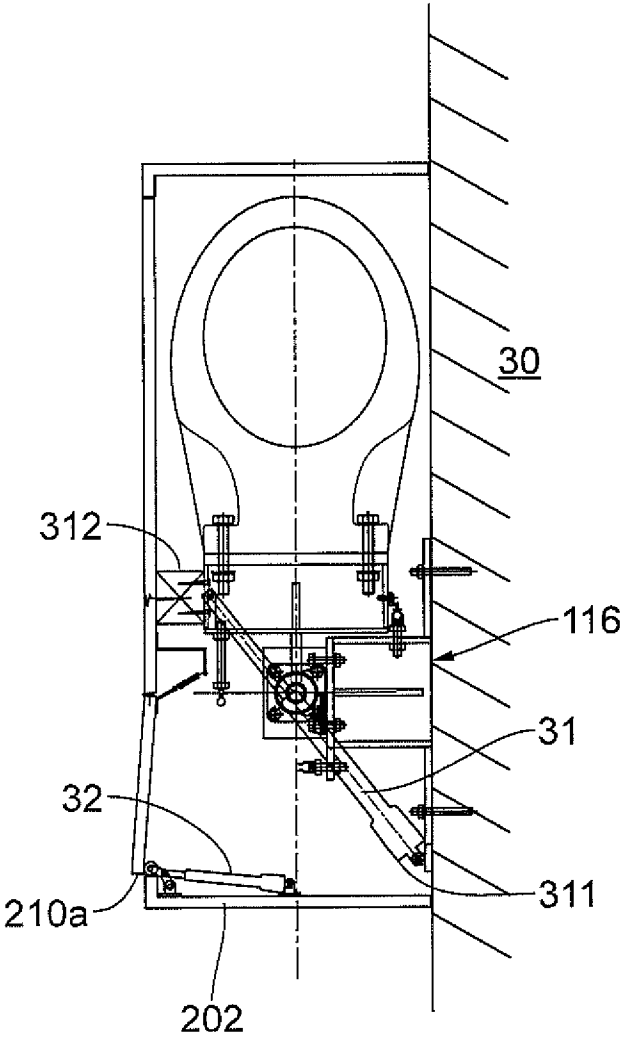
FIGS. 3A to 3G illustrate a sequence of opening and/or closing of the installed system including a mounting assembly according to embodiments of the invention.
Figure 3A:
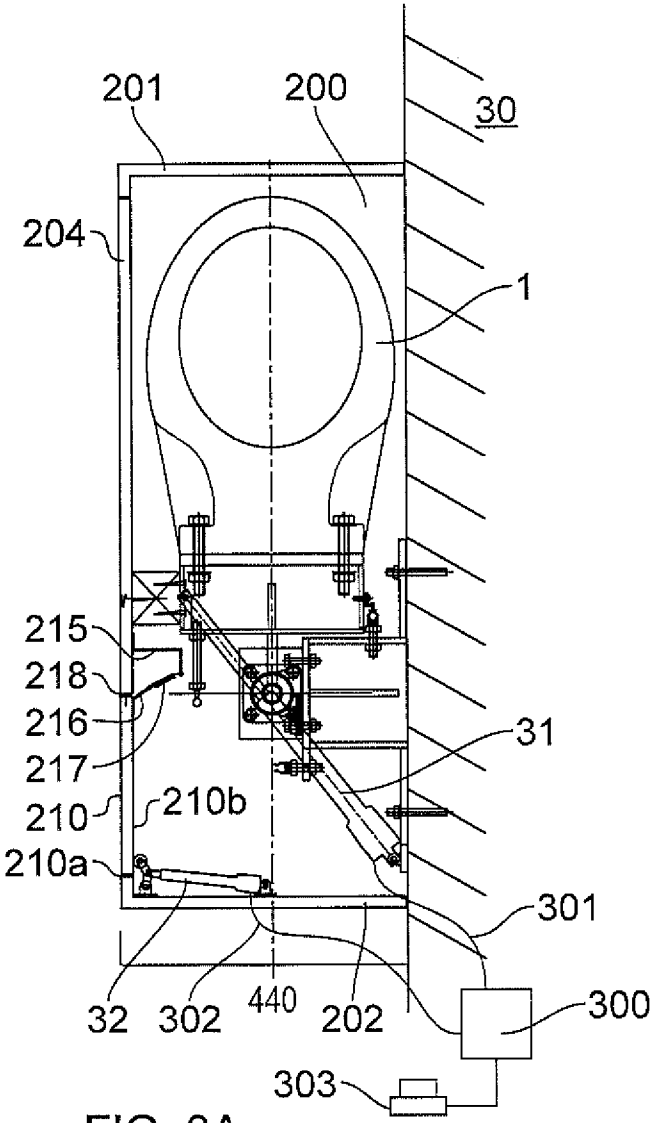
Figure 3D:
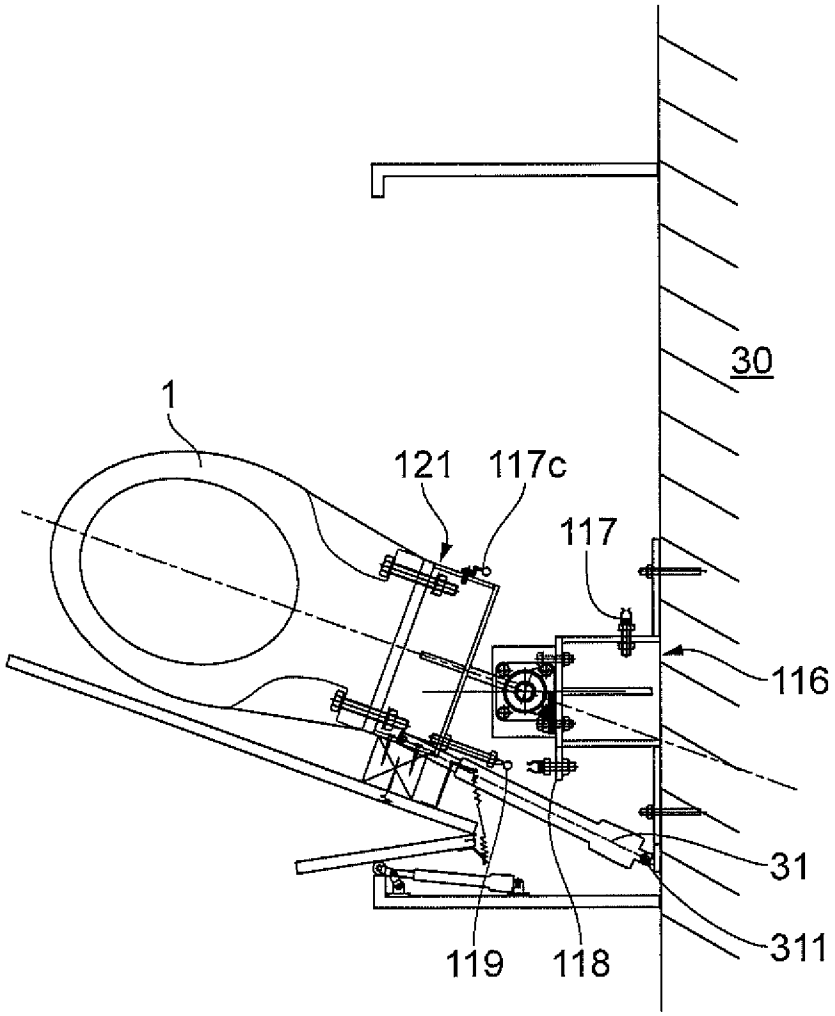
Figure 3C:
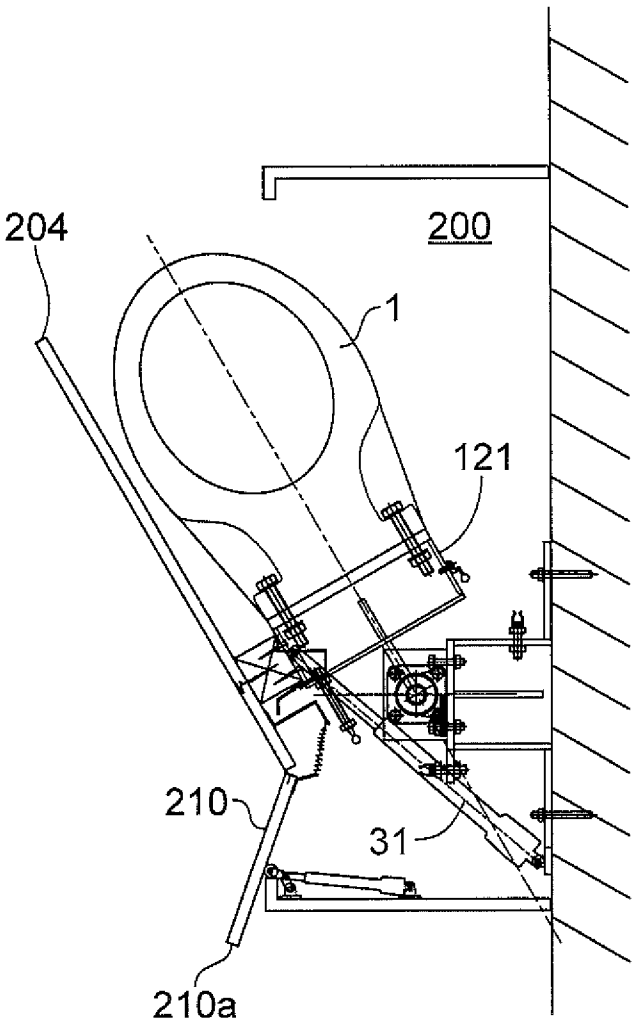
Figure 3E:
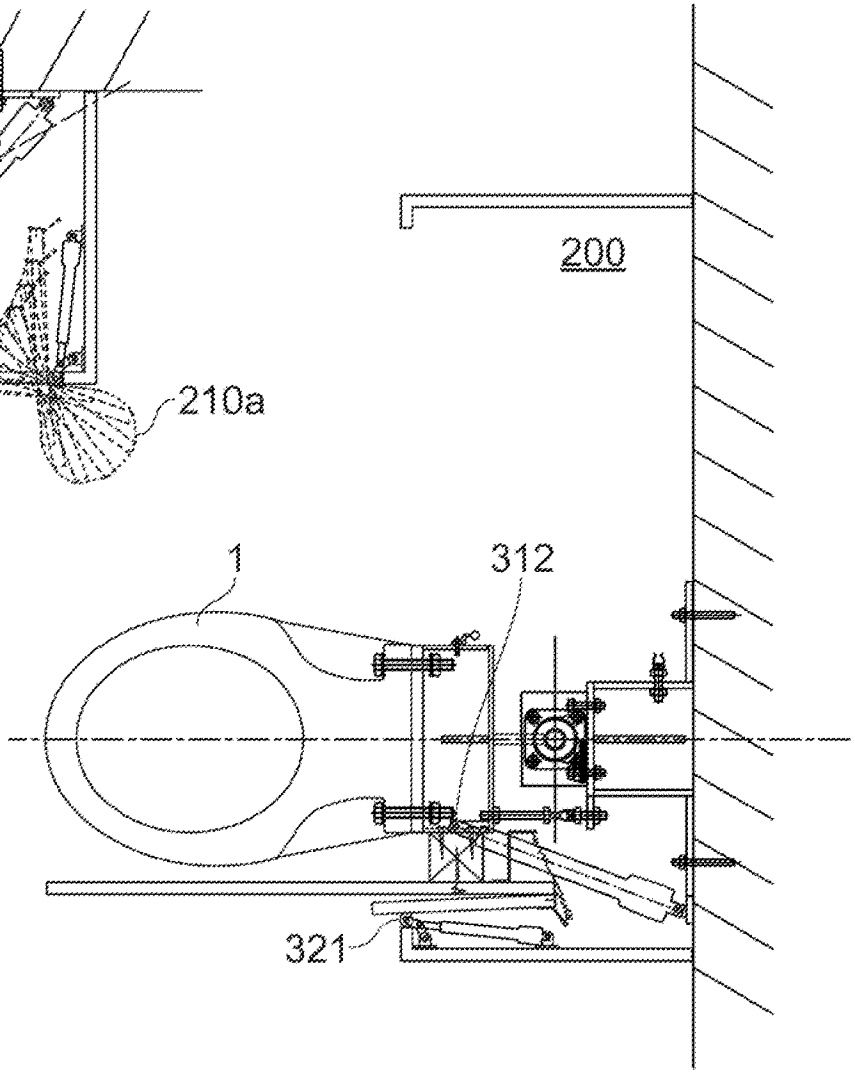

As illustrated in FIG. 3D, further actuation of the actuator 31, moves the lavatory pan 1 and dynamic chassis 121 further toward its deployed position, which can be seen in FIG. 3E, where the lavatory pan 1 has reached its fully deployed position for use. The procedure of returning the pan 1 to its stowed position is a procedure following the reverse of the above.

Actuator 32 is not fixedly connected to door 210. Rather, its primary function is to extend an idler wheel 321 outwardly relative to the interior space of the enclosure 200, then the inner surface 210*b* of the door 210 can move passed the idler wheel 321 as the dynamic chassis 212 is moved between its stowed and deployed positions. The tension spring 217 biases the door inner surface 210*b* against the idler wheel 321 during this movement.

Figure 3F:
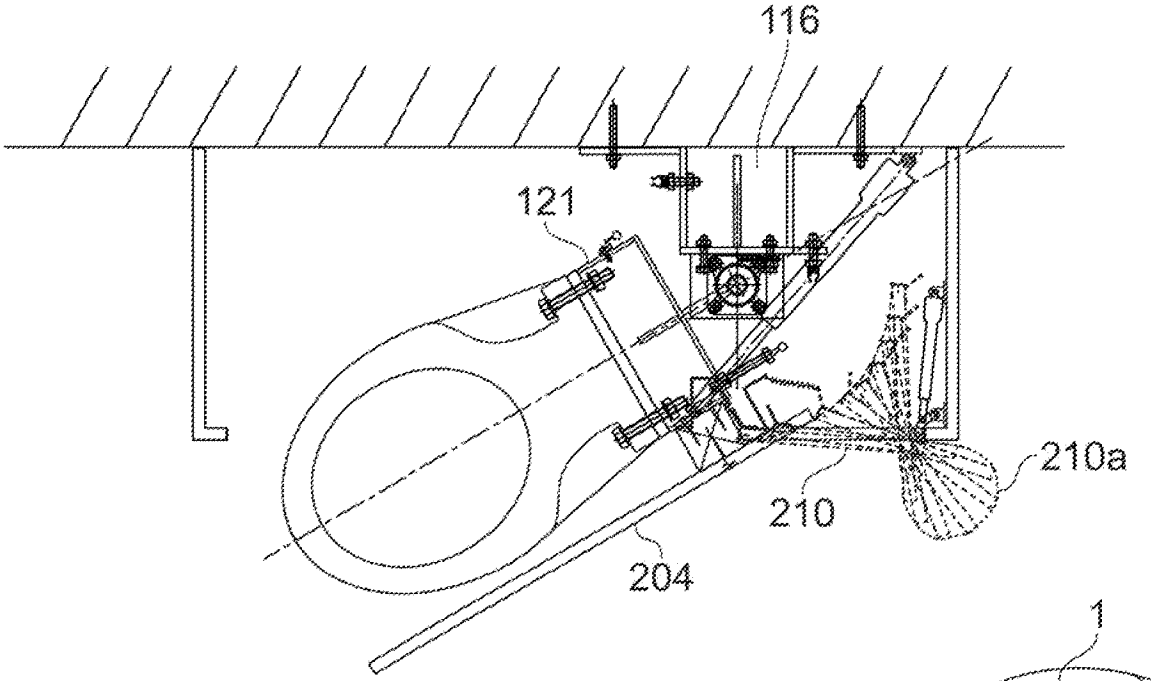

FIG. 3F illustrates the path of the outer end 210*a* of the door 210 as the dynamic chassis 212 and the main door 204 move between their stowed and deployed positions.

Figure 3G:
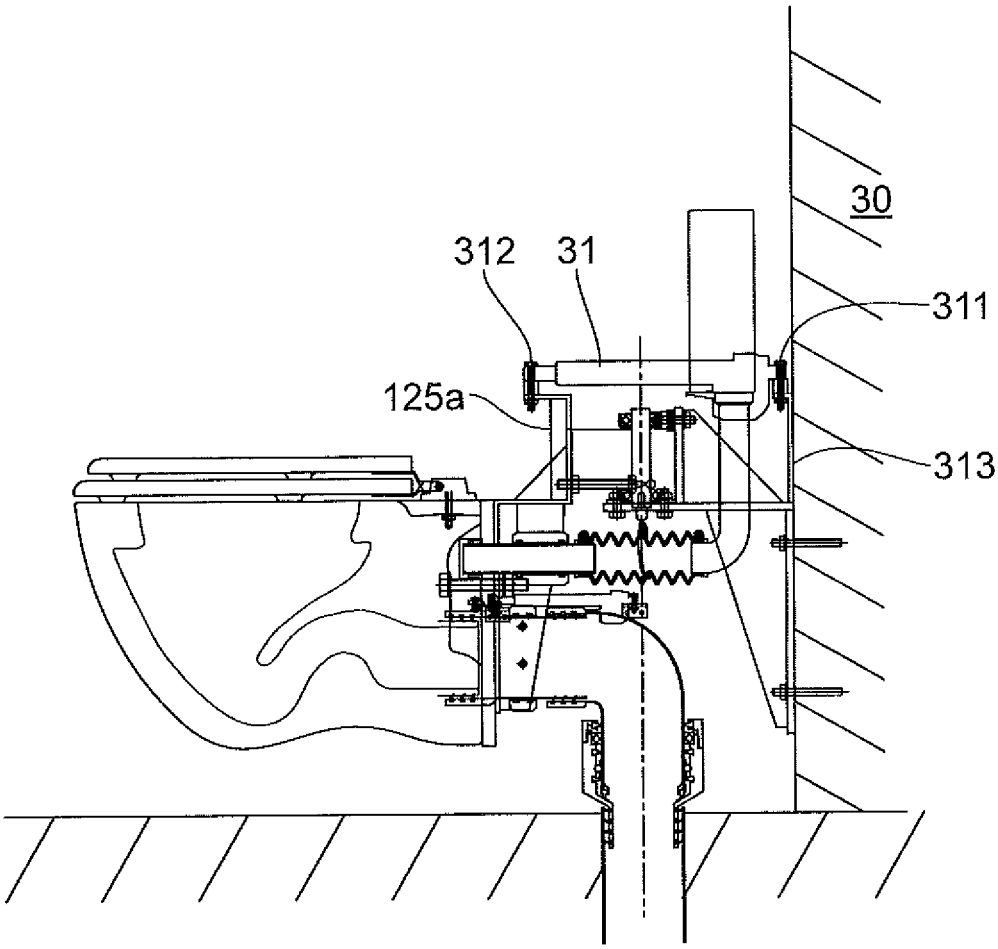

FIG. 3G illustrates a side view of the position of the actuator 31, and the connection of its first end 311 to wall 30 via a plate 313, which may be separate to, or integrated with the fixed chassis 116. At the second end 312, the actuator 31 can be fixed to the dynamic chassis 121 via simple rotatable connection, such as a spherical bearing, a rod eye, or a bolt passing through a plate 125*a* as illustrated in FIG. 3G. One or more bearing arrangements may be provided to allow rotation of the bolt relative to the plate and/or relative to the actuator.

A releasable retaining means 118 can also be provided in any of the embodiments, as shown in FIGS. 3A to 3G. This can take the same form as the releasable retainer means 117 described in relation to the earlier figures. Corresponding connector means 117*c* and 119 are illustrated, for releasable connection into the retaining means 117 and 118, respectively and their function is as described in relation to FIGS. 3A to 3G. Retaining means 118 acts to retain the chassis in the deployed position, while retaining means 117 can additionally or alternatively retain the chassis in the stowed position.

Figure 4A:
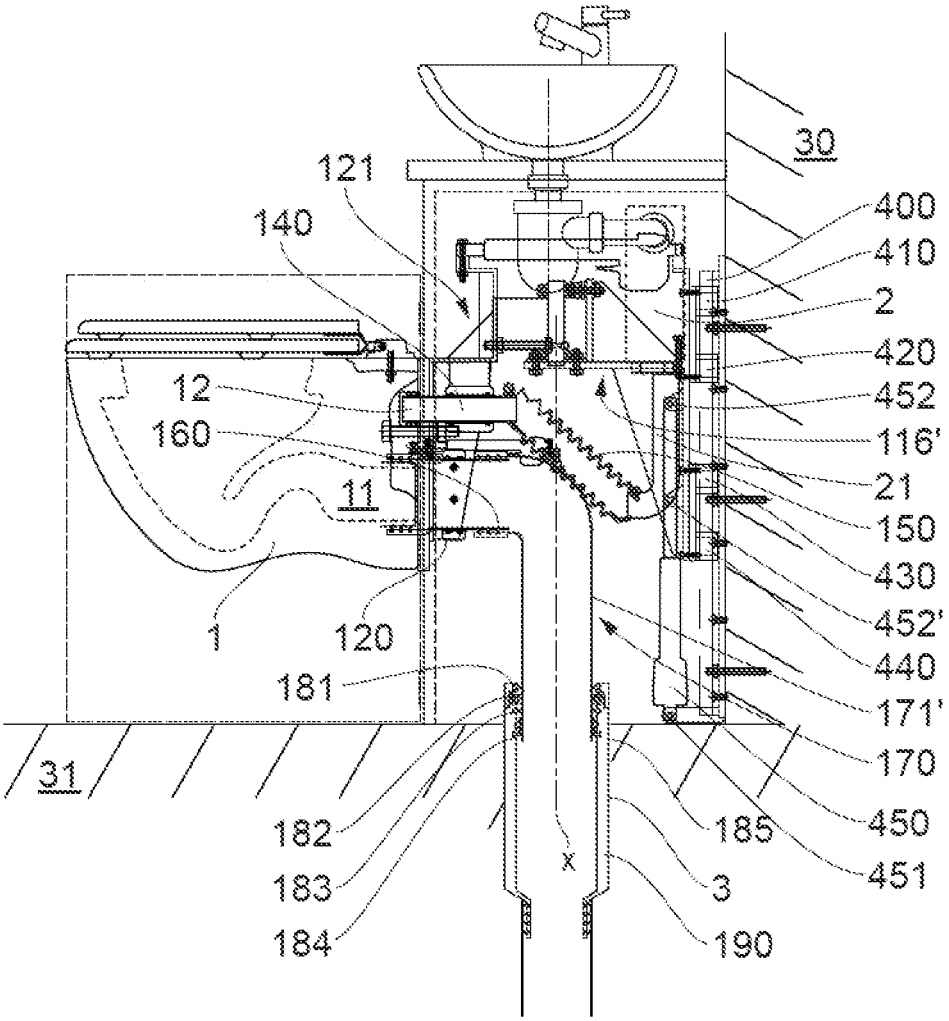
FIGS. 4A to 4C illustrate height adjustment means incorporated into a mounting assembly in accordance with embodiments of the invention.
Figure 4B:
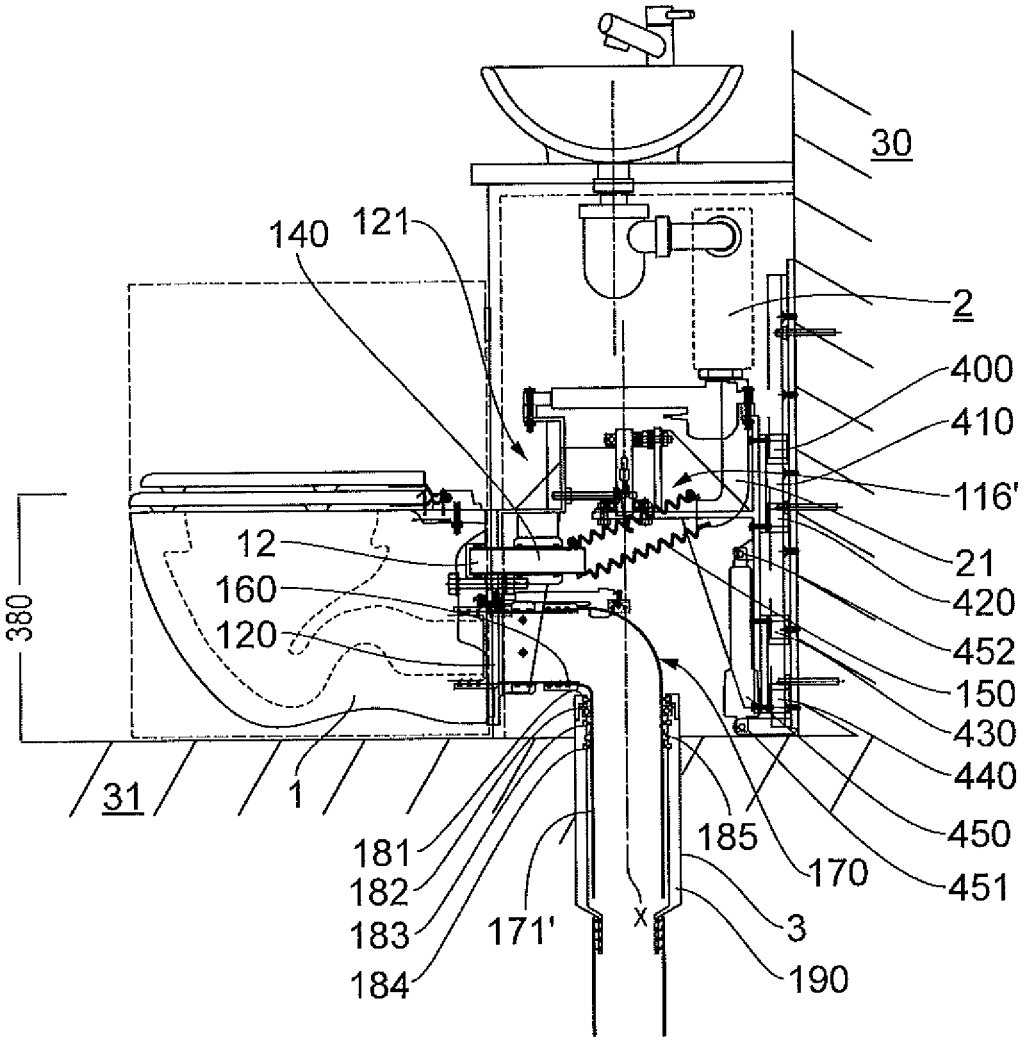
Figure 4C:
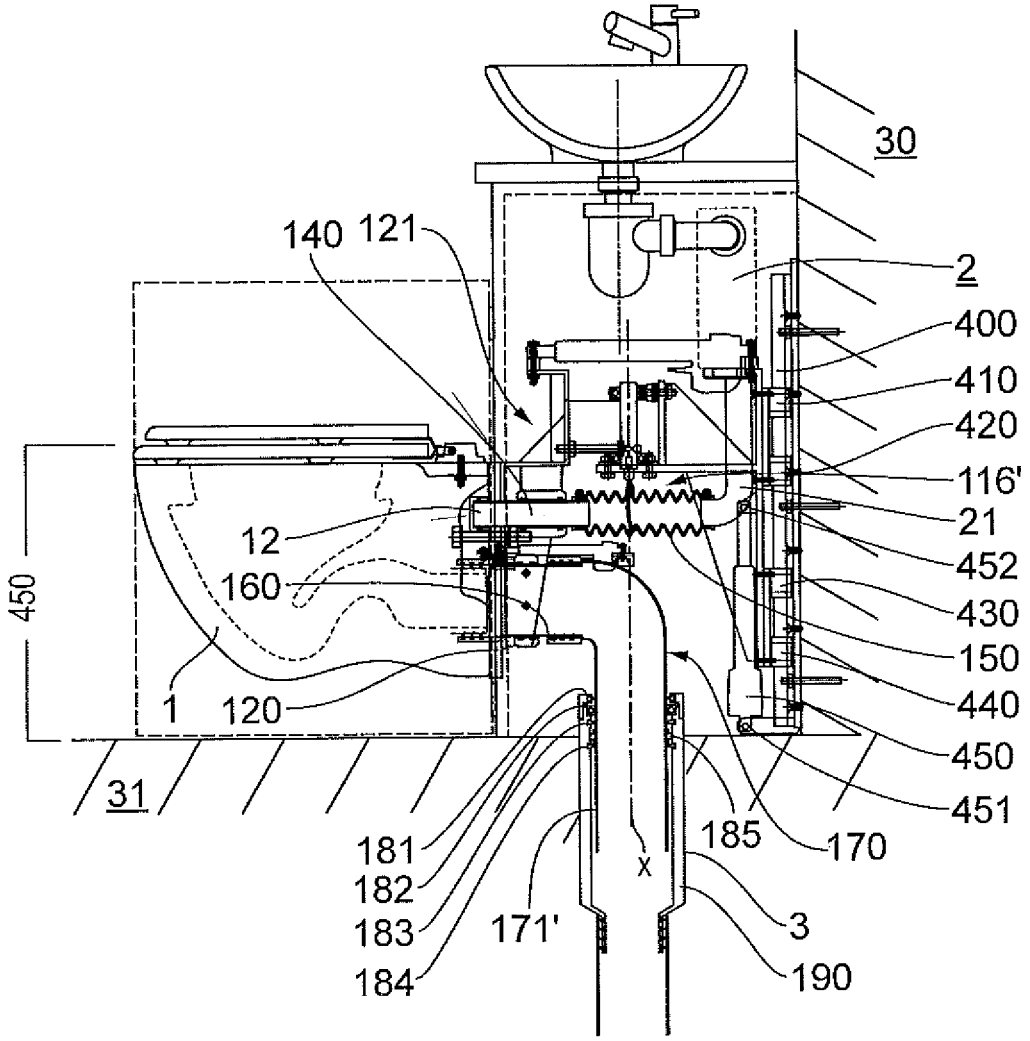

FIGS. 4A to 4C show exemplary embodiments in which height adjustment means for the moveable brackets are provided. According to these embodiments, the mounting assembly further comprises means for adjusting the height of the bracket 120 relative to the wall 30. The support assembly is therefore configured so as to provide both movement of the plumbed item between stowed and deployed positions in a substantially horizontal plane, and also substantially vertical height adjustment of the plumbed item for users requiring the item to be mounted for use at different heights relative to the floor.

In the examples of FIGS. 4A to 4C, the components of the static chassis 116 and the dynamic chassis 121 are substantially the same as those discussed in relation to the earlier figures, with the main exception being that the static chassis 116 becomes a height-adjustable static chassis, such that it is substantially static in terms of the deployment or stowage of the lavatory pan 1, but is capable of being displaced vertically to adjust the height of the mounting assembly 100, in particular the bracket 120. Further, in these embodiments, the waste water connection, as well as allowing for rotation of the waste outlet 11 of the lavatory pan 1 relative to the fixed waste port 3, it is also configured to permit substantially vertical translation between the waste outlet 11 and extender 160, and the fixed waste port 3. In the embodiment illustrated, this is achieved by the L-bend 171' having an additional extended length in the vertical direction, such that it can extend into and out of the fixed waste port 3. To accommodate this, the fixed outlet adaptor 190 has an extended length, with the bearings 182 and/or 185 being provided at an interior surface of the fixed waste port adaptor 190, and the lip seals 181, 183 and 184 being provided in the same manner as for the earlier embodiments described herein. The waste water connection can therefore be provided with a telescopic arrangement, where a first part 171' of the connection is able to slip longitudinally in and out of a second part 190 of the arrangement, so as to permit longitudinal changes in length of that section. In the embodiment of FIG. 4A, this provides variability to the height of the mounting assembly and lavatory pan 1. It will be described in relation to later figures how such a telescoping arrangement can be used in a substantially horizontal arrangement to allow bracket 120 and lavatory pan 1 to translate between stowed and deployed positions.

A substantially vertical height adjustment of the support assembly can be achieved via a substantially vertical slide track as illustrated in FIGS. 4A to 4C. The static chassis 116' is mounted to a static slide track 400 via slideable connection means 410, 420, 430, 440, which enables the static chassis 116' to be displaced in a substantially vertical direction relative to the wall 30. The slideable connection means may be any form of roller arrangement configured to be mounted to the track 400 to retain the height-adjustable static chassis 116' thereto, while permitting vertical displacement of the chassis 116'. An actuator 450 can be connected between a fixed point 451 which is fixed relative to the wall 30 and the floor 31, while at a second point 452, the actuator 450 can be connected to the vertically adjustable chassis 116'. As can be appreciated from FIG. 4A, linear actuation of the actuator 450 will result in the second end 452 being displaced between a first, upper, position 452, and a second position 452'. Displacing the connection point 452, 452' between those locations will result in variations in height of the height adjustable chassis 116', and the remainder of the mounting assembly 100 with it. As will be appreciated, it is also necessary to provide a connection between the water supply inlet extender 140 and the cistern 2, or other substantially fixed water supply means such as the fixed pipe 21. In the illustrated embodiment, a flexible pipe is provided, and so long as the pipe 150 is both flexible and extendible, such as in the case of the bellows-type arrangement illustrated, it will be able to permit both vertical displacement of the extender 140 and water inlet 12, as well as rotation about the axis X, between the stowed and deployed positions of the bracket 120. Although the pipe 150 is not shown properly connected to the extender 140 and pipe 21 in FIG. 4A it will be appreciated by a skilled reader that a duly flexible pipe member 150 can be connected to those elements and its flexure will allow it to provide a closed fluid connection path between extender 140 and pipe 21 to deliver water to the item 1 from cistern 2 in all the positions shown in FIGS. 4A to 4C.

FIG. 4B shows the arrangement of FIG. 4A in a lower position. As can be seen from the figure, the L bend 171' of the waste water connection has extended into the fixed waste port adaptor 190 to accommodate the change in height of the support assembly. Further, flexure of the water supply connection 150 enables the water supply to be delivered to the extender 140 in this position. As will be appreciated, actuator 450 has been retracted to its shortest configuration, in order to lower the height adjustable static chassis 116' and the mounting assembly 100'.

As will be appreciated, FIG. 4C illustrates an intermediate height arrangement, where the height adjustable static chassis 116' is in between its first, highest, position illustrated in FIG. 4A, and its second, lowest, position illustrated in FIG. 4B. This height may be preferred for a "standard" able-bodied user of average height. The lowest arrangement at FIG. 4B may be suitable for users of below-average height, such as children, while a higher arrangement as shown in FIG. 4A may be preferred for those less able to stand after sitting in a low position, such as the elderly or those of limited physical ability. The mounting assembly of FIGS. 4A to 4C can therefore provide height adjustability to the bracket 120, whilst also permitting the dynamic chassis 121 to be displaced between stowed and deployed positions in a substantially horizontal plane.

FIGS. 5A to 5D illustrate an alternative embodiment, in which the lavatory pan 1 is displaced between its stowed position within an enclosure 200', and a deployed position outside of the enclosure 200', by means of substantially linear translation in a substantially horizontal plane. Similar to the earlier embodiments, a dynamic chassis 521, and a static chassis 516 are provided. However, the displacement of the dynamic chassis 521 relative to the static chassis 516 in this embodiment is provided by linear sliders or runners. The dynamic chassis 521, is mounted to a set of linear runners or tracks 511 and 512. Bracket 520 of the dynamic chassis 521 is mounted to a plurality of sliding elements, numbered 561 to 568 in the figure, which slide in a substantially linear fashion along the runners 511 and 512. Whilst the dynamic chassis 521 is extended into a deployed position, releasable retaining means 518 can hold the dynamic chassis 521 in the deployed position. Similarly, once in the stowed position, releasable retaining means 517, can retain the dynamic chassis 51 in its stowed position. The releasable retaining means 517 and 518 are substantially as described in relation to those shown in the earlier figures.

Figure 5A:
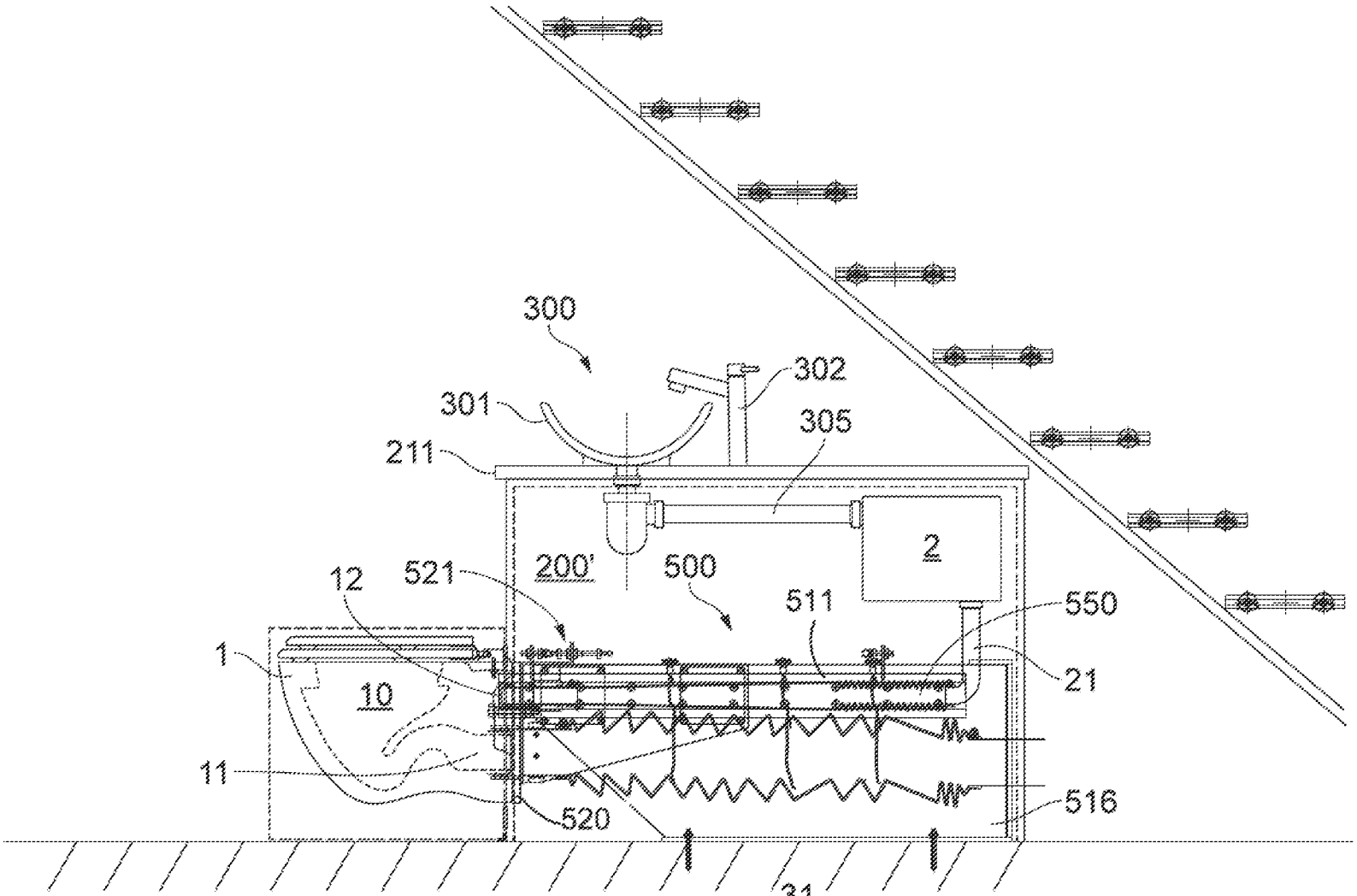
FIGS. 5A to 5D illustrate a system for translational deployment of an item of plumbed equipment according to further embodiments of the invention.
Figure 5B:
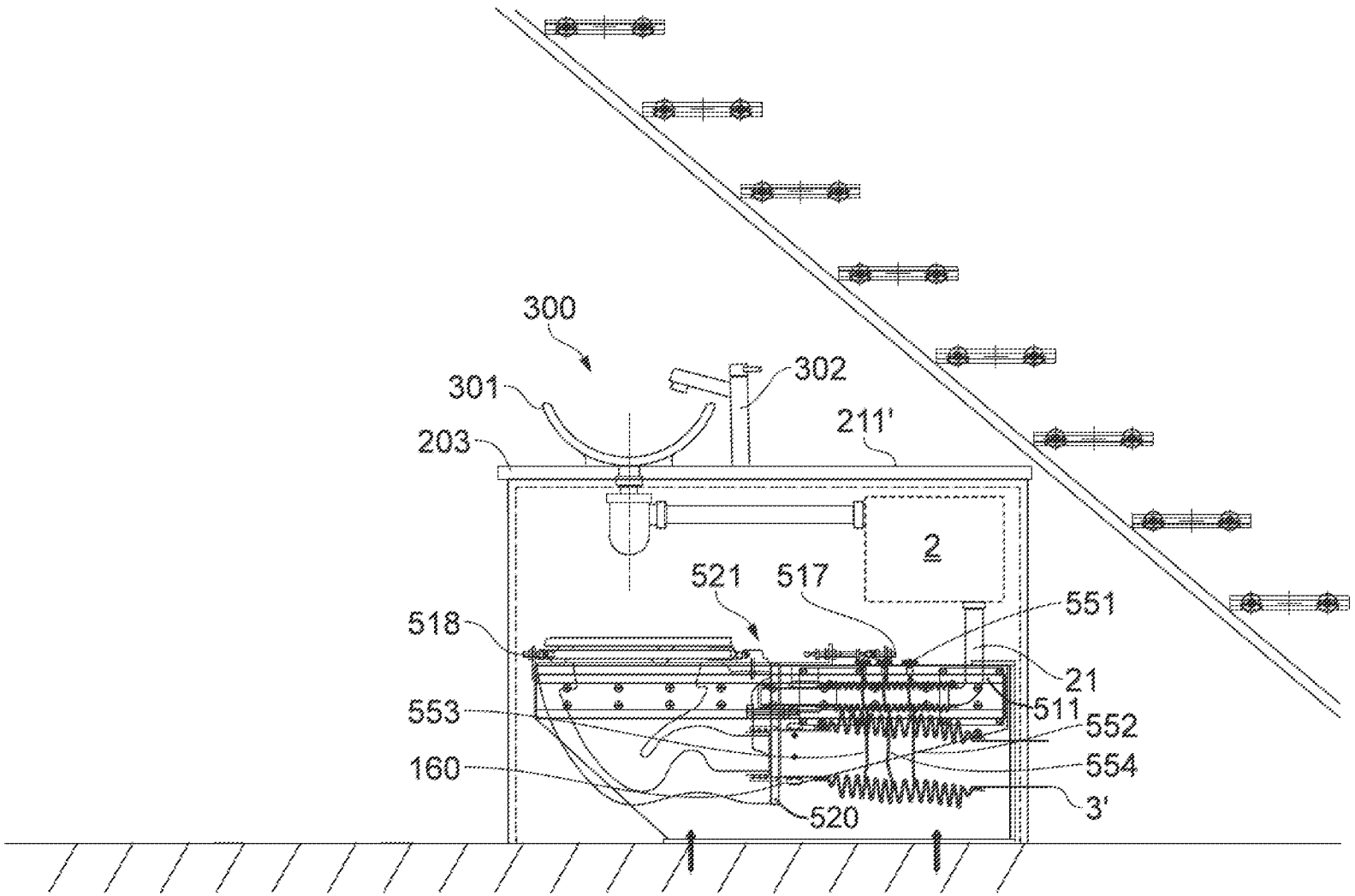

As can be seen in FIG. 5B in particular, the connection from the waste extender 160 to the fixed waste port 3' in this embodiment can be provided by an extendable bellows-type pipe connection. Further, one or more supports may be slideably mounted to the static chassis, for example by wheeled runners 551, carrying looped supports 552, 553 and 554. As described in relation to FIG. 4A, a telescopic arrangement for the waste outlet connection comprising a first part 171' extending within a second part 190, could be employed to permit the forward and rearward linear displacement of the dynamic chassis 521. This can enable the necessary corresponding lengthening and shortening of the waste connection, from the waste extender 160 to the static waste port 3', as the dynamic chassis 521 is displaced in substantially linear fashion. A similar type of telescopic arrangement could also be provided in place of the bellows-type pipe arrangement illustrated for the water supply connection 550.

Figure 5C:
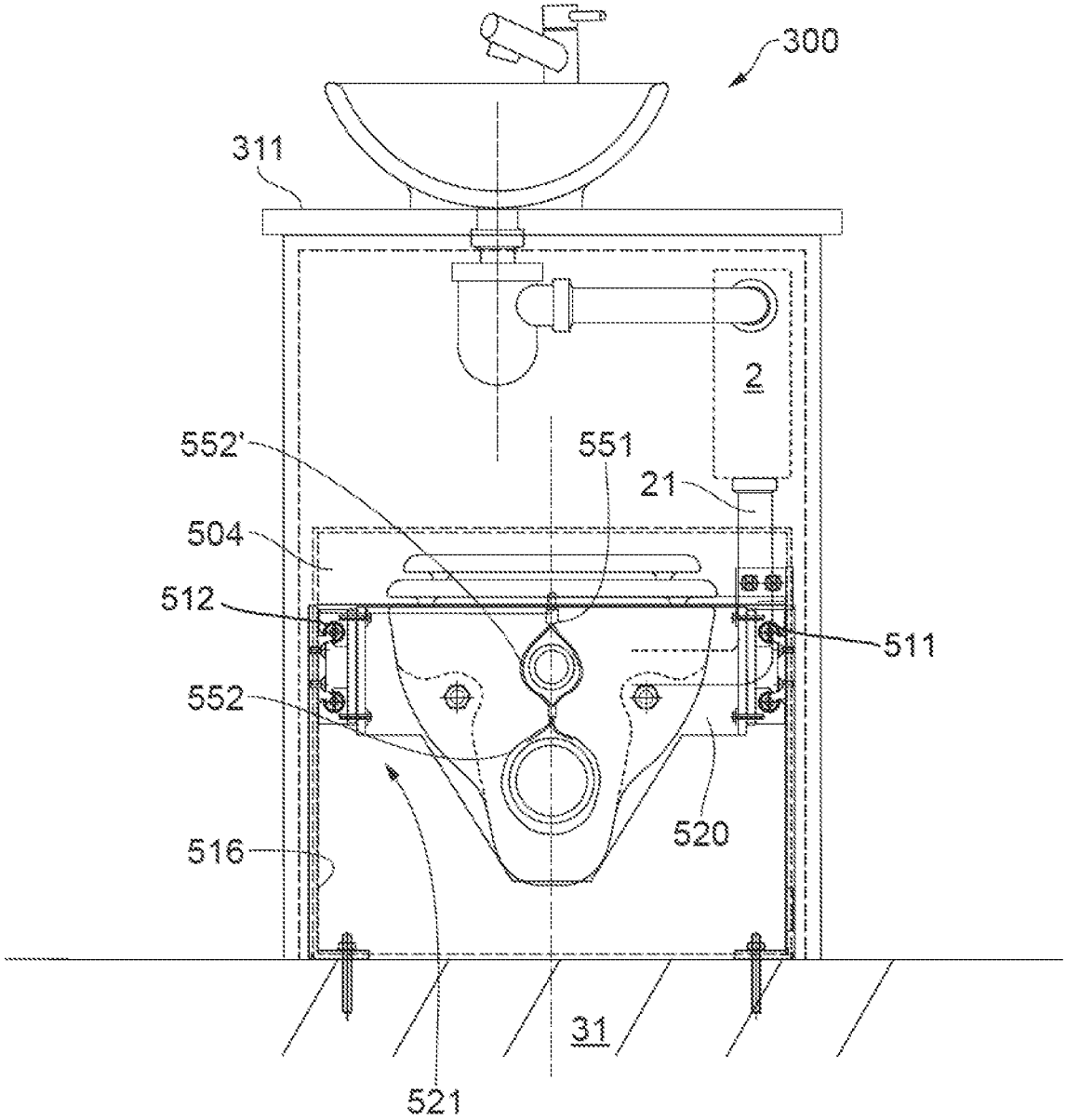
Figure 5D:
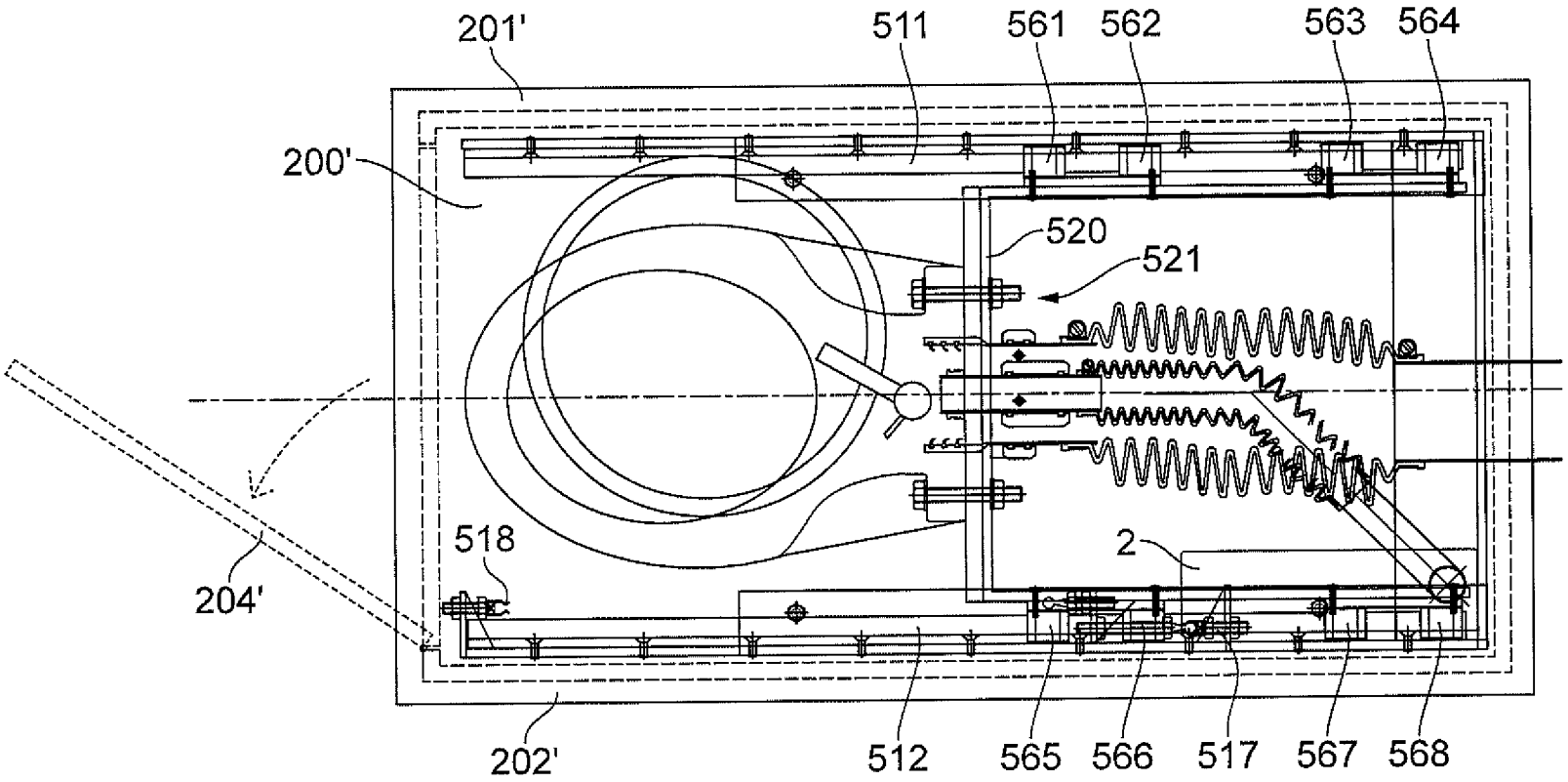

Other features already described in relation to the earlier figures are not described in detail in relation to FIGS. 5A to 5D, but as can be appreciated from the drawings, corresponding features of those earlier embodiments can be incorporated into the linear translating embodiment illustrated in FIGS. 5A to 5C. For example, an access door 504 can be employed to conceal the lavatory pan 1 when in its stowed position. Further, a basin installation can be provided on an upper surface 211' of the enclosure 200 as described in relation to the earlier figures, carrying a similar connection to the system 2 as described in relation to those earlier figures.

Further, it will be possible to provide a height adjustable static chassis in the embodiment of FIGS. 5A to 5D, by mounting the static chassis 516 in height adjustable manner relative to the floor 31. Similar vertical slides to those illustrated in relation to FIGS. 4A to 4C could be provided either side of the static chassis 516 in order to raise and lower the static chassis, making it a height-adjustable static chassis. Given the extended length of the static chassis 516, it may be necessary to have a plurality, such as 4, of the actuators and slide sets disposed in spaced pairs on either side of the static chassis 516, order to provide even balancing to the height-adjustable static chassis 516'. In such a manner, a linearly displaceable and height adjustable mounting assembly can be provided including any or all of the features already illustrated and described in relation to FIGS. 5A to 5D.

Figure 6B:
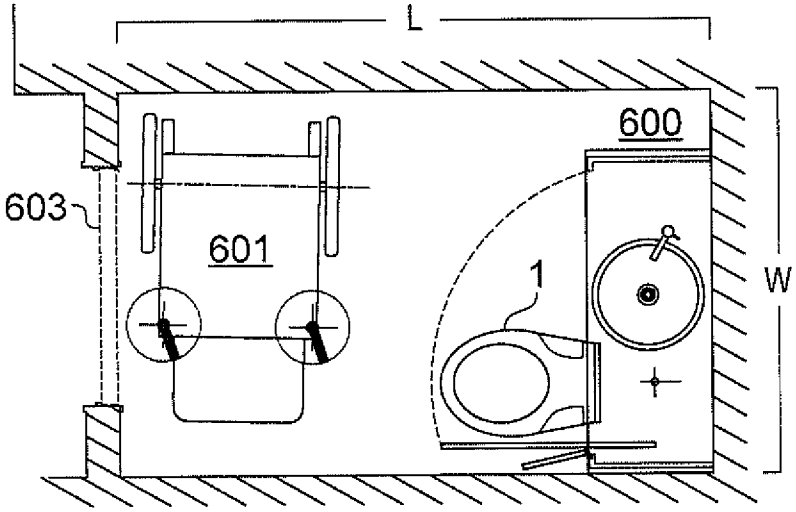
FIGS. 6A to 6C illustrate a first installation using a mounting assembly according to embodiments of the invention.
Figure 6A:
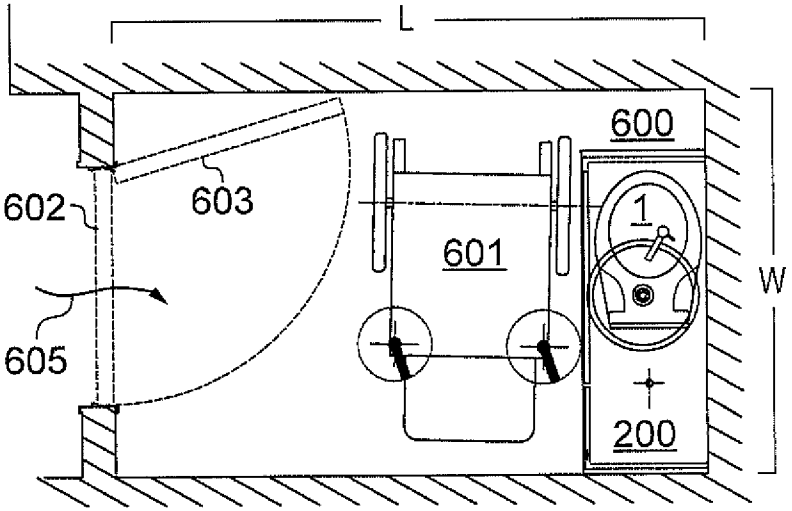
Figure 6C:
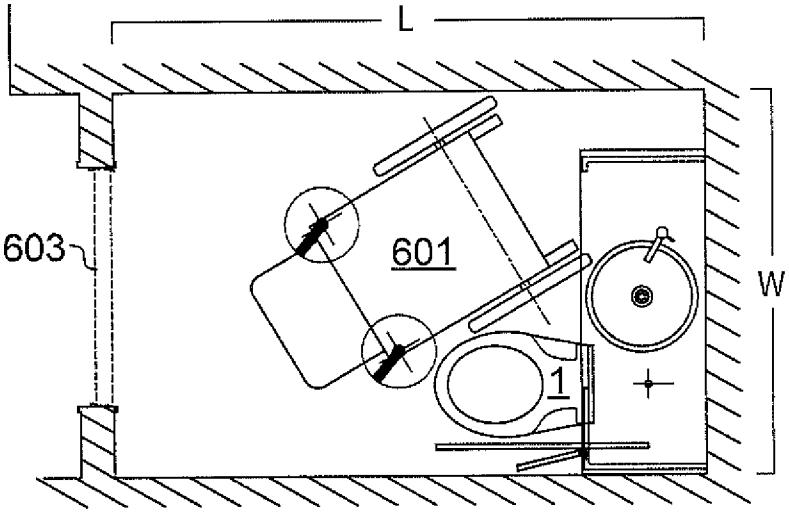

FIGS. 6A to 6C illustrate a scheme for utilising a mounting assembly of the invention in a disabled toilet facility. As will be appreciated in viewing the figures, since the lavatory pan 1 can be stowed before and after use, a greater surface area of the floor of a room is available for a wheelchair user to enter the room and to close the door before using the lavatory pan 1. Under current regulations, for example under UK building regulations, for newly built structures, a standard disabled toilet should be minimum 2200 mm by 1500 mm, with an outward opening door. However, in existing houses or other buildings, it may not be practical or economical to build such new rooms to those new requirements, and the doors will often open inwards.

FIGS. 6A to 6C illustrate a room having a length L of approximately 2.2 m and a width W of approximately 1.4 m. In the first step of FIG. 6A, the wheelchair user 601 can enter the room through the doorway 602 with the inwardly opening door 603 in its open position as shown by arrow 605. Once the wheelchair user 601 is adjacent to the enclosure 200 containing the lavatory pan mounted to a mounting assembly of the invention (not shown for the clarity of this schematic illustration) then the door can be closed. The illustrated schemes show the rotational deployment of the lavatory pan 1 between its fixed and stowed positions, but the benefits of additional available floor space can be realised with either the rotational versions, or the linear version of the mounting assembly.

In accordance with FIG. 6B, the wheelchair user 601 can therefore move toward the closed door 603 to allow space for the lavatory pan 1 to be swung into its deployed position. The wheelchair user 601 can therefore approach the lavatory pan 1 once in its deployed position as they would a standard lavatory pan in a standard disabled toilet facility. As will be appreciated, this allows a room to be adapted for use by a wheelchair user without a need to enlarge the existing space, or install an externally opening door.

Figure 7B:
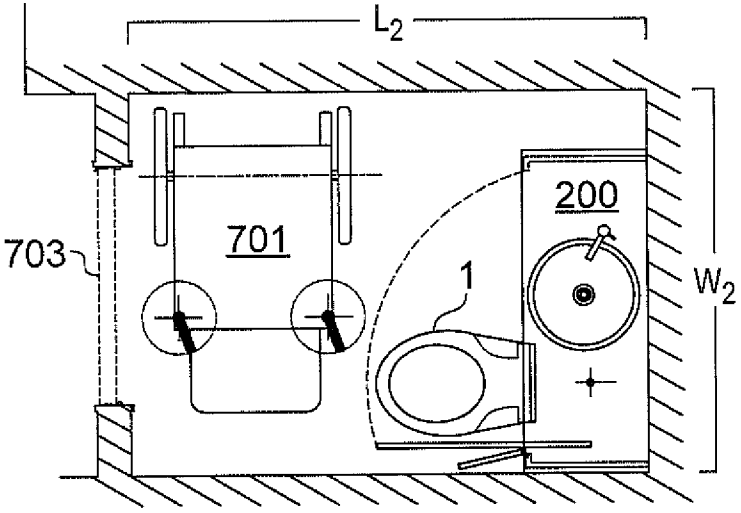
FIGS. 7A to 7C illustrate a further installation using a mounting assembly according to embodiments of the invention.
Figure 7A:
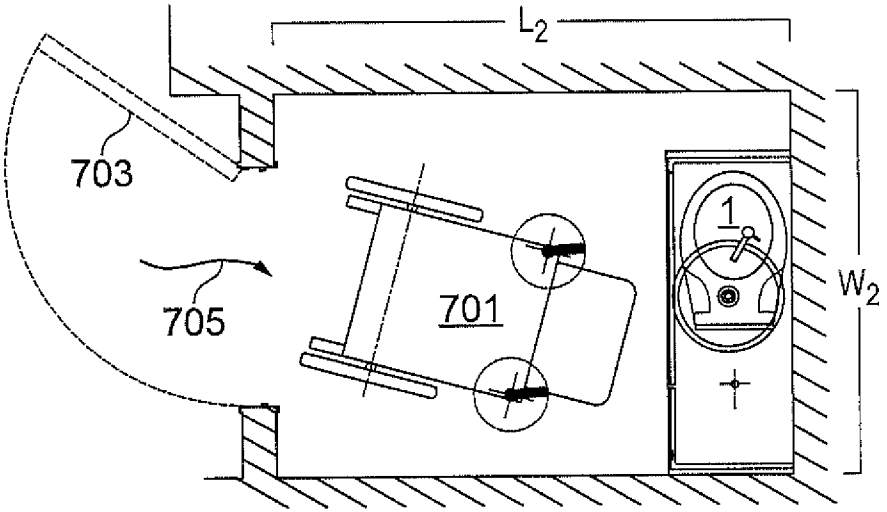
Figure 7C:
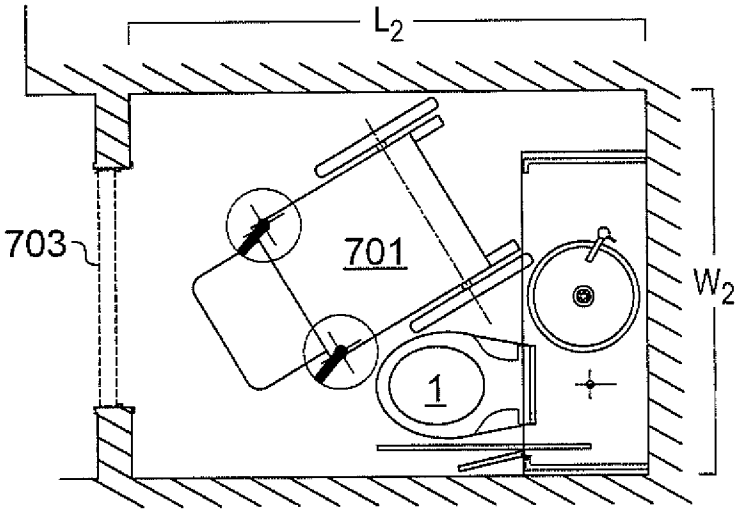

FIGS. 7A to 7C illustrate a similar situation but where an externally opening door 703 is provided. In this case, the wheelchair user 701 enters the room via the open door 703 following arrow 705. Door 703 is once more closed as shown in FIG. 7B and the wheelchair user 703 can distance themselves from the enclosure 200 to allow deployment of the lavatory pan 1. Again, as illustrated in FIG. 7C, the wheelchair user 701 can again approach the lavatory pan 1 in the usual way. In the example shown in FIGS. 7A to 7C, the length L2 of the room can be reduced to as little as around 1.8 m, and generally significantly less than the 2.2 m requirement of standard building regulations.

Figure 8B:
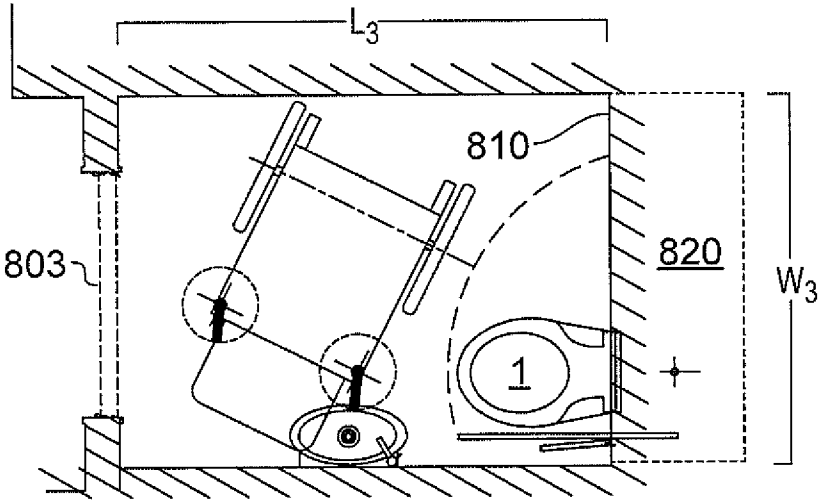
FIGS. 8A to 8C illustrate a further installation using a mounting assembly according to embodiments of the invention.
Figure 8A:
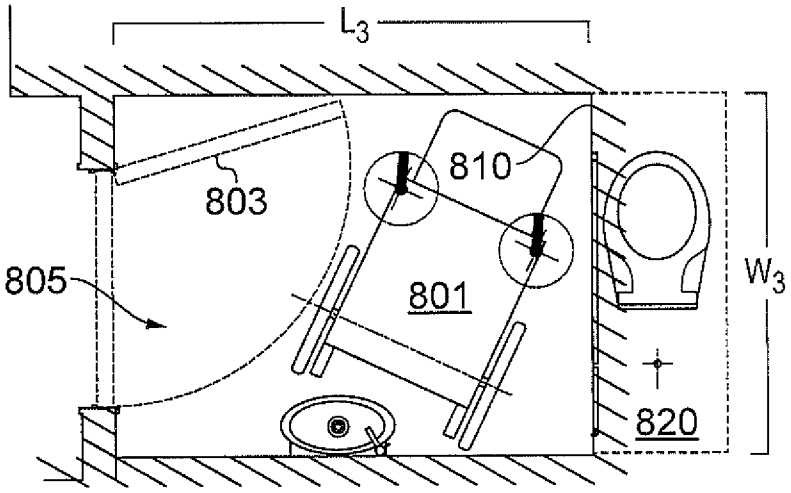
Figure 8C:
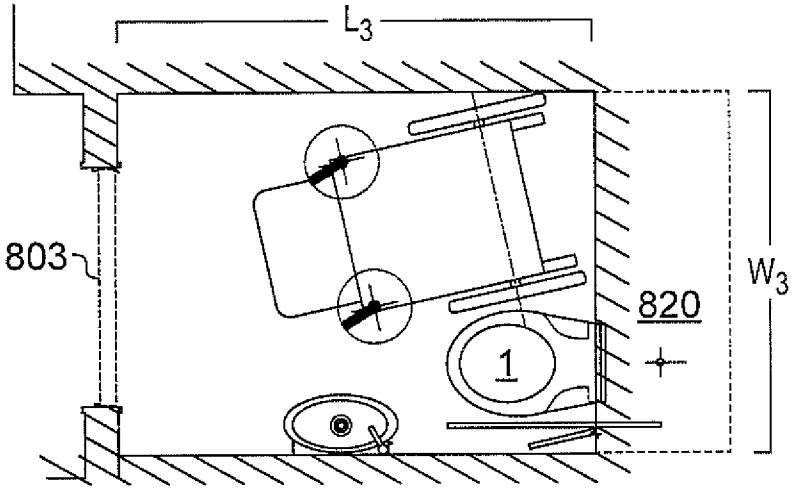

FIGS. 8A to 8C illustrate a similar situation but where an end wall 810 conceals an enclosure 820 into which an item mounted to a mounting assembly of embodiments of the invention can be retracted, in a stowed position. In this case, the wheelchair user 801 enters the room via the open door 803 following arrow 805. Door 803 is once more closed as shown in FIG. 8B and the wheelchair user 803 can distance themselves from the enclosure wall 810 to allow deployment of the lavatory pan 1. Again, as illustrated in FIG. 8C, the wheelchair user 801 can again approach the lavatory pan 1 in the usual way. In the example shown in FIGS. 8A to 8C, the length $L_3$ of the room can be reduced to as little as around 1.7 m, so long as the required space for enclosure 820 behind wall 810 can be provided, for example under eves of a loft or under a lower part of a sloped staircase. The room size required can again be generally significantly less than the 2.2 m length L required by standard building regulations.

Therefore, using the mounting assembly of the present invention, it is possible to adapt a smaller room than is normally required for use by disabled users. Further, even when building new facilities, a smaller than previously possible disabled facility can be constructed by wheelchair users. When space is at a premium in both new buildings and repurposed old buildings, this is an important and useful feature of the systems and methods enabled by the mounting assembly described herein. Further, as can be appreciated the stowage of the pan 1 when not in use frees-up floor space for other uses. In particular, in under-stairs or loft installations, the space under the sloped eaves, or under the lower part of the stairs can be more effectively utilised and allows greater floor space to be provided in the room. Under-stairs facilities and lift conversions can therefore benefit from the floor space usage increase provided by the invention, along with the benefits for disabled toilet access described in relation to FIGS. 6A to 8C. Although the invention has been described above with reference to one or more preferred embodiments, it will be appreciated that various changes or modifications may be made without departing from the scope of the invention as defined in the appended claims.

The invention claimed is:

1. A mounting assembly for movably mounting an item of plumbed equipment to a fixed surface, the mounting assembly comprising:

a support assembly including a fixed support and a movable bracket configured to receive the item of plumbed equipment, the support assembly configured to movably mount the movable bracket to the fixed surface via the fixed support, so as to move the item of plumbed equipment between a first, stowed, position, and a second, deployed, position;

a water supply connection, configured to connect a water supply from a fixed supply point to the item of plumbed equipment; and a waste water connection, configured to moveably connect a waste outlet of the item of plumbed equipment to a fixed waste port; wherein the support assembly is configured to wholly support a weight of the item of plumbed equipment through the movable bracket without contact with ground beneath the item of plumbed equipment, the fixed support providing a cantilevered support to the movable bracket, the cantilevered support passing above the water supply connected to the water supply connection and above a waste water pipe connected to the waste water connection; and wherein the movable bracket comprises a waste opening and a water supply opening to allow passage of the waste water and water from the water supply through the movable bracket.

2. The mounting assembly according to claim 1, wherein the movable bracket is configured with a flat front face configured to accept a toilet pan.

3. The mounting assembly according to claim 1, wherein the mounting assembly is configured to support a load at a center of a toilet bowl of 270 kgs.

4. The mounting assembly according to claim 1, wherein: the movable bracket is movably mounted to, and supported by, the fixed support.

5. The mounting assembly according to claim 1, wherein the water supply connection comprises:

a fixed water supply connector for connection to the water supply in fixed relation to the fixed support;

a movable water supply connector for connection to a water inlet of the item of plumbed equipment, the movable water supply connector being mounted in fixed relation to the movable bracket; and a movable fluid connection including a fixed end connected to the fixed water supply connector and a mobile end connected to the movable water supply connector.

6. The mounting assembly according to claim 1, wherein the waste water connection comprises:

a fixed waste connector for connection to the fixed waste port in fixed relation to the fixed support;

a movable waste connector for connection to the waste outlet of the item of plumbed equipment, the movable waste connector being mounted in fixed relation to the movable bracket; and a movable waste connection including a fixed end connected to the fixed waste connector and a mobile end connected to the movable waste connector.

7. The mounting assembly according to claim 1, wherein the fixed support comprises a plurality of fixing points for fixing the fixed support to one or more surfaces, the plurality of fixing points being vertically or horizontally spaced from one another when installed, so as to fully support the weight of the item of plumbed equipment in the first, stowed and second, deployed positions.

8. The mounting assembly according to claim 1, wherein movement of the item of plumbed equipment provided by the support assembly between the first, stowed and second, deployed positions comprises translation and/or rotation in a horizontal plane.

9. The mounting assembly according to claim 1, wherein the mounting assembly further comprises a water supply extender configured to extend the water supply through the movable bracket; and further comprises a waste water extender configured to extend the waste outlet of the item of plumbed equipment through the movable bracket.

10. The mounting assembly according to claim 1, further comprising a door for enclosing the item of plumbed equipment when in the first, stowed position, the door being fixedly mounted to the movable bracket, wherein the door comprises first and second door portions being hingedly connected to one another; and wherein the mounting assembly further comprises a door actuator configured to automatically actuate at least one of the door portions to enable the door to open when the item of plumbed equipment is moved from the first, stowed position to the second, deployed position.

11. The mounting assembly according to claim 1, further comprising a bracket actuator, for actuating the movable bracket to move it between the first, stowed and second, deployed positions, and further comprising at least one latch for retaining the item of plumbed equipment in the first, stowed position and/or the second, deployed position.

12. The mounting assembly according to claim 1, further comprising: a movable connection between a height adjustable chassis of the support assembly and the movable bracket; and movable height adjustment means, for adjusting a height of the movable bracket relative to the fixed surface to a user's needs, wherein the height adjustment means are configured to change the height the movable bracket and a height of the movable connection.

13. The mounting assembly according to claim 12, wherein the height adjustment means comprises a vertical slide disposed between the movable bracket and the fixed support of the support assembly.

14. The mounting assembly according to claim 12, wherein the moveable height means is powered or manually operated, for adjusting the height of the movable bracket relative to the fixed support of the support assembly.

15. The mounting assembly according to claim 1, wherein the support assembly comprises one or more hinges for moving the item of plumbed equipment between the first, stowed and second, deployed positions by a rotational motion, the one or more hinges being mounted so as to be above the water supply connection and above the waste water connection when installed; and wherein the hinge comprises a plurality of bearings, the bearings being separated vertically from one another so as to support a full weight of the item of plumbed equipment being supported on the movable bracket via the bearings.

16. The mounting assembly according to claim 15, wherein the support assembly comprises a back plate for mounting the fixed support to a wall, a first spacer member arranged to hold the one or more hinges in spaced relation to the wall on the fixed support, and a bracket connection arranged to hold the movable bracket in spaced relation to the hinge;

wherein, when installed, the one or more hinges is configured coaxially with the fixed waste port, such that a vertical axis of rotation of the one or more hinges is coaxial with the fixed waste port.

17. A kitchen, bathroom, water closet or other plumbing arrangement comprising the item of plumbed equipment of claim 1 mounted so as to be movable between the first, stowed and second, deployed positions via the mounting assembly.

18. A method of making a kitchen, bathroom or other plumbing installation, comprising:

installing the mounting assembly of claim 1;

mounting the item of plumbed equipment to the movable bracket; and connecting the water supply and/or waste water connection to the item of plumbed equipment.

19. A mounting assembly for movably mounting an item of plumbed equipment to a fixed surface, comprising:

a support assembly comprising a fixed support and a movable bracket configured to receive the item of plumbed equipment, the support assembly configured to movably mount the movable bracket to the fixed surface via the fixed support, so as to move the item of plumbed equipment between a first, stowed, position, and a second, deployed, position;

a water supply connection, configured to connect a water supply from a fixed supply point to the item of plumbed equipment; and a waste water connection, configured to moveably connect a waste outlet of the item of plumbed equipment to a fixed waste port; wherein the support assembly is configured to wholly support a weight of the item of plumbed equipment through the movable bracket without contact with ground beneath the item of plumbed equipment, the fixed support providing a cantilevered support to the plumbed equipment in the second, deployed position, wherein the movable bracket comprises a waste opening and a water supply opening to allow passage of the waste water and water from the water supply through the movable bracket; and wherein the support assembly comprises one or more horizontal linear sliding elements, configured to translate the item of plumbed equipment between the first, stowed and second, deployed positions by linear movement.

20. The mounting assembly according to claim 19, wherein the water supply connection and/or the waste water connection comprises a pipe arrangement configured to be length adjustable along a longitudinal axis thereof to adapt the length of the pipe arrangement as the item of plumbed equipment moves between the second, deployed and first, stowed positions, wherein the length adjustable pipe arrangement has first and second ends and is supported between the first and second ends by one or more linearly displaceable supports, configured to move linearly as the item of plumbed equipment moves between the first, stowed and second, deployed positions.

* * * * *